US008951707B2

(12) United States Patent
Amemori et al.

(10) Patent No.: US 8,951,707 B2
(45) Date of Patent: Feb. 10, 2015

(54) TONER, DEVELOPER AND IMAGE FORMING APPARATUS

(71) Applicants: Suzuka Amemori, Shizuoka (JP); Atsushi Yamamoto, Osaka (JP); Masahide Yamada, Shizuoka (JP); Yukiko Nakajima, Kanagawa (JP); Shinya Nakayama, Shizuoka (JP); Hideyuki Santo, Kanagawa (JP)

(72) Inventors: Suzuka Amemori, Shizuoka (JP); Atsushi Yamamoto, Osaka (JP); Masahide Yamada, Shizuoka (JP); Yukiko Nakajima, Kanagawa (JP); Shinya Nakayama, Shizuoka (JP); Hideyuki Santo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 2 days.

(21) Appl. No.: 14/013,428

(22) Filed: Aug. 29, 2013

(65) Prior Publication Data

US 2014/0065534 A1 Mar. 6, 2014

(30) Foreign Application Priority Data

Aug. 31, 2012 (JP) ..... 2012-192118
Jan. 15, 2013 (JP) ..... 2013-004595

(51) Int. Cl.
*G03G 9/087* (2006.01)
*G03G 9/097* (2006.01)

(52) U.S. Cl.
CPC ..... *G03G 9/08764* (2013.01); *G03G 9/08782* (2013.01); *G03G 9/08797* (2013.01); *G03G 9/09733* (2013.01)
USPC ..... 430/109.4; 430/108.1; 430/108.9

(58) Field of Classification Search
USPC ..... 430/109.4, 108.1, 108.9
See application file for complete search history.

(56) References Cited

U.S. PATENT DOCUMENTS

| | | | | |
|---|---|---|---|---|
| 2008/0050669 | A1* | 2/2008 | Ohmura et al. | 430/109.4 |
| 2008/0171280 | A1* | 7/2008 | Ohmura et al. | 430/109.4 |
| 2012/0282000 | A1 | 11/2012 | Nakayama et al. | |
| 2013/0078563 | A1 | 3/2013 | Nakayama et al. | |
| 2013/0108950 | A1 | 5/2013 | Yamamoto et al. | |
| 2013/0115550 | A1 | 5/2013 | Amemori et al. | |
| 2013/0143155 | A1 | 6/2013 | Santo et al. | |

FOREIGN PATENT DOCUMENTS

| | | | |
|---|---|---|---|
| AU | 2006235981 | 12/2007 | |
| JE | 2004163515 | * 6/2004 | G03G 9/08 |
| JP | 2006-276069 | 10/2006 | |
| JP | 2007-079329 | 3/2007 | |
| JP | 2007-310064 | 11/2007 | |

OTHER PUBLICATIONS

Machine English language translation of JP 2004163515, Jun. 2004.*
U.S. Appl. No. 13/790,541, filed Mar. 8, 2013.
(Continued)

*Primary Examiner* — Hoa V Le
(74) *Attorney, Agent, or Firm* — Oblon, Spivak, McClelland, Maier & Neustadt, L.L.P.

(57) ABSTRACT

A toner, including: a crystalline resin containing a urethane bond, a urea bond, or both thereof; and a compound represented by the following General Formula (1), wherein an amount of the compound represented by the General Formula (1) is 0.01% by mass to 0.25% by mass:

$C_nH_{2n+1}R$ General Formula (1)

where n is 8 to 22 and R is COOH, $NH_2$ or OH.

20 Claims, 5 Drawing Sheets

(56) References Cited

OTHER PUBLICATIONS

U.S. Appl. No. 13/783,810, filed Mar. 4, 2013.
U.S. Appl. No. 13/790,525, filed Mar. 8, 2013.
U.S. Appl. No. 13/783,561, filed Mar. 4, 2013.

* cited by examiner

TONER, DEVELOPER AND IMAGE FORMING APPARATUS

BACKGROUND OF THE INVENTION

1. Field of the Invention

The present invention relates to a toner, a developer and an image forming apparatus.

2. Description of the Related Art

Conventional electrophotographic image forming apparatus and electrostatic recording apparatus use a toner to visualize electric or magnetic latent images. For example, in electrophotography, an electrostatic image (latent image) is formed on a photoconductor and then developed with a toner to form a toner image. The toner image is generally transferred onto a recording medium such as paper and then fixed thereon by means of, for example, heating.

Image forming apparatus that perform fixing by means of heating require a large amount of electricity in the process of heating and melting a toner to fix it on a recording medium such as paper. Thus, in terms of achievement of energy saving, low-temperature fixing property is an important property of a toner.

In order to improve a toner in low-temperature fixing property, it is necessary to control thermal properties of a binder resin occupying most of the toner. However, decreasing the softening temperature of a binder resin leads to a problem that its heat-resistant storage stability is degraded. Then, in one proposed toner that contains a binder resin containing a crystalline resin as a main ingredient, the composition and thermal properties of the crystalline resin are defined to fall within specific ranges (see, for example, Japanese Patent Application Laid-Open (JP-A) No. 2010-077419). In another proposal, a toner containing, as a binder resin, two different kinds of crystalline resins having different molecular weights (crystalline polyester resins are particularly preferred) are used under specific fixing conditions (see, for example, JP-A No. 2009-014926). In still another proposal, two different kinds of crystalline polyester resins having different storage elastic moduli at 160° C. are used as a binder resin (see, for example, JP-A No. 2010-151996).

Any of these proposed techniques can improve low-temperature fixing property in some degree while maintaining heat-resistant storage stability, but use of a crystalline resin as a binder resin causes a problem of degradation in transferability.

Therefore, at present, demand has arisen for provision of a toner excellent in transferability as well as heat-resistant storage stability and low-temperature fixing property.

SUMMARY OF THE INVENTION

The present invention aims to solve the above existing problems and achieve the following object. That is, an object of the present invention is to provide a toner excellent in transferability as well as heat-resistant storage stability and low-temperature fixing property.

Means for solving the above problems are as follows.

That is, a toner of the present invention contains: a crystalline resin containing a urethane bond, a urea bond, or both thereof; and a compound represented by the following General Formula (1), wherein an amount of the compound represented by the General Formula (1) is 0.01% by mass to 0.25% by mass:

$$C_nH_{2n+1}R \qquad \text{General Formula (1)}$$

where n is 8 to 22 and R is COOH, $NH_2$ or OH.

The present invention can provide a toner excellent in transferability as well as heat-resistant storage stability and low-temperature fixing property. The toner of the present invention can solve the above existing problems.

DETAILED DESCRIPTION OF THE INVENTION (Toner)

Figure 1A:
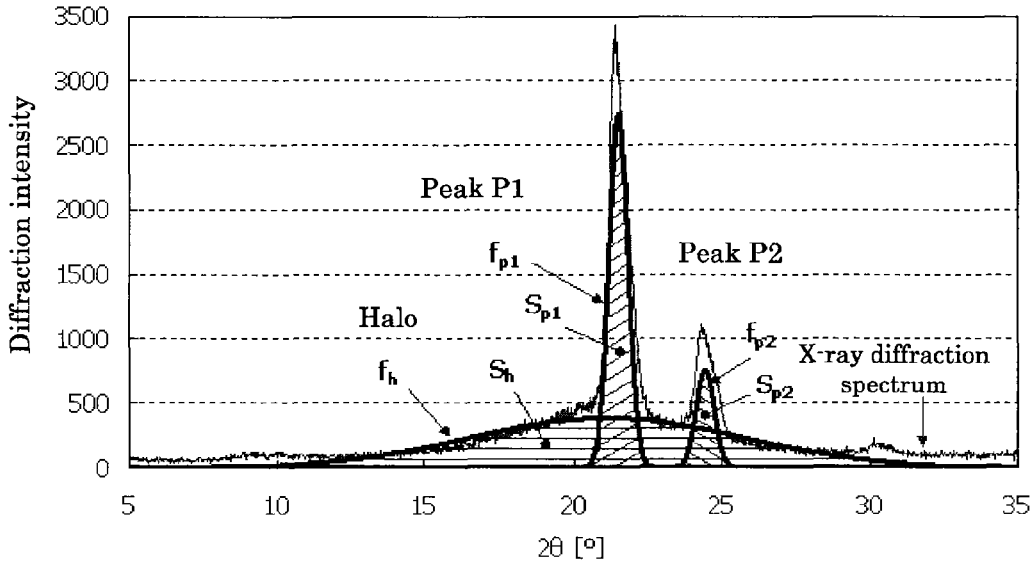
FIG. 1A is a diagram illustrating one example of a diffraction spectrum obtained by an X-ray diffraction measurement.

A toner of the present invention contains a crystalline resin containing a urethane bond, a urea bond, or both thereof, and a compound represented by the following General Formula (1); and, if necessary, further contains other ingredients.

In the above toner, an amount of the compound represented by the following General Formula (1) is 0.01% by mass to 0.25% by mass.

$$C_nH_{2n+1}R \qquad \text{General Formula (1)}$$

In the General Formula (1), n is 8 to 22 and R is COOH, $NH_2$ or OH.

A toner containing a crystalline resin as a binder resin tends to be excellent in low-temperature fixing property and heat-resistant storage stability, but be poor in transferability. This tendency is more significant as the amount of the crystalline resin is larger.

The present inventors conducted studies about this problem and as a result have found that the crystalline resin in the toner is low in electrical resistance. This is likely because a non-crystalline portion of the crystalline resin easily conducts electricity therethrough. When the electrical resistance of the crystalline resin in the toner is low, the electrical resistance of the toner is also low, and as a result the toner is degraded in transferability to an image-receiving member (e.g., an intermediate transfer belt).

In view of this, the present inventors conducted extensive studies focusing on decreasing the non-crystalline portion in the crystalline resin; i.e., increasing the crystallinity of the crystalline resin, and as a result have found that excellent transferability can be obtained by incorporating into a toner a specific amount of the compound represented by the above General Formula (1). The present inventors conducted further studies and have found that combinational use of a specific crystalline resin and a specific amount of the compound represented by the above General Formula (1) can give a toner excellent in transferability as well as heat-resistant storage stability and low-temperature fixing property. The present invention has been accomplished on the basis of these findings.

<Binder Resin>

The binder resin contains a crystalline resin; and, if necessary, further contains other resins such as a non-crystalline resin.

—Crystalline Resin—

The crystalline resin contains a crystalline resin containing a urethane bond, a urea bond, or both thereof; and, if necessary, further contains other crystalline resins.

The crystalline resin containing a urethane bond, a urea bond, or both thereof preferably contains a first crystalline resin and a second crystalline resin having a weight average molecular weight greater than that of the first crystalline resin.

The first crystalline resin and the second crystalline resin are preferably crystalline resins having different compositions. Notably, "crystalline resins having different compositions" refer, for example, to crystalline resins at least one kind of monomer of which is different therebetween. As another example, the first crystalline resin and the second crystalline resin is a combination of a crystalline resin containing a urethane bond and a crystalline resin containing a urea bond.

The second crystalline resin is preferably a crystalline resin formed by extending a crystalline resin containing an isocyanate group at an end thereof. The method for extending the crystalline resin is, for example, a method by reacting the crystalline resin containing an isocyanate group at an end thereof with a compound having a functional group reactive with an isocyanate group. Examples of the compound having a functional group reactive with an isocyanate group include water and the below-described amine compounds. This extension may be performed in an aqueous medium for producing a toner.

The amount of the crystalline resin in the binder resin is not particularly limited and may be appropriately selected depending on the intended purpose. The amount thereof is preferably 50% by mass or more, more preferably 65% by mass or more, further preferably 80% by mass or more, particularly preferably 95% by mass or more, from the viewpoint of allowing the crystalline resin to show low-temperature fixing property and heat-resistant storage stability in a well-balanced manner. Also, it is preferably 50% by mass or more from the viewpoint of obtaining remarkable effects of the present invention that a toner excellent in transferability as well as heat-resistant storage stability and low-temperature fixing property is provided in view that a toner that contains a binder resin containing a crystalline resin as a main ingredient (the amount of the crystalline resin in the binder resin is 50% by mass or more) is excellent in heat-resistant storage stability and low-temperature fixing property, but is particularly significantly poor in transferability due to low crystallinity of the crystalline resin.

—Crystalline Resin Containing a Urethane Bond, a Urea Bond, or Both Thereof—

Examples of the crystalline resin containing a urethane bond, a urea bond, or both thereof (e.g., the first crystalline resin and the second crystalline resin) include a crystalline resin containing a urethane bond and a crystalline resin containing a urea bond.

Further examples of the crystalline resin containing a urethane bond, a urea bond, or both thereof include a crystalline polyester resin containing a urethane bond, a urea bond, or both thereof.

Examples of the crystalline resin containing a urethane bond include a urethane-modified crystalline polyester resin and a crystalline urethane resin.

Examples of the crystalline resin containing a urea bond include a urea-modified crystalline polyester resin and a crystalline urea resin.

—Urethane-Modified Crystalline Polyester Resin—

The urethane-modified crystalline polyester resin can be obtained, for example, through reaction between a crystalline polyester resin and a divalent or higher valent isocyanate compound or through reaction between a crystalline polyester resin containing an isocyanate group at an end thereof and a polyol component.

Examples of the crystalline polyester resin include a polycondensation polyester resin synthesized through polycondensation between a polyol component and a polycarboxylic acid component, a lactone ring-opening polymerization product, and polyhydroxycarboxylic acid. Among these, a polycondensation polyester resin of a diol component and a dicarboxylic acid component is preferred in view of development of crystallinity.

—Diol Component—

The diol component is not particularly limited and may be appropriately selected depending on the intended purpose, but is preferably aliphatic diols.

The number of carbon atoms in the chain in the diol component is not particularly limited and may be appropriately selected depending on the intended purpose, but is preferably 2 to 36.

Examples of the aliphatic diol include a linear-chain aliphatic diol and a branched-chain aliphatic diol. Preferred are the linear-chain aliphatic diol, and more preferred are C4 to C6 linear-chain aliphatic diols.

The diol component may be used in combination. An amount of the linear-chain aliphatic diols is preferably 80 mol % or greater, more preferably 90 mol % or greater relative to the total amount of diol components. Use of the linear-chain aliphatic diols in an amount of 80 mol % or greater is preferable because crystallinity of the resin is improved, both of low temperature fixing property and heat-resistant storage stability are desirably provided to the resulting resin, and the hardness of the resin tends to increase.

The linear-chain aliphatic diol is not particularly limited and may be appropriately selected depending on the intended purpose. Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,15-pentadecanediol, 1,16-hexadecanediol, 1,17-heptadecanediol, 1,18-octadecanediol, and 1,20-eicosanediol. Among them, preferred are ethylene glycol, 1,3-propanediol, 1,4-butanediol, 1,6-hexanediol, 1,9-nonanediol, and 1,10-decanediol, and more preferred are 1,4-butanediol and 1,6-hexanediol, because they are readily available.

Examples of optionally used diols include C2 to C36 aliphatic diols other than the above-described aliphatic diols (e.g., branched-chain aliphatic diols such as 1,2-propylene glycol, 1,3-butanediol, neopentyl glycol, and 2,2-diethyl-1,3-propanediol); C4-C36 alkylene ether glycols (e.g., diethylene glycol, triethylene glycol, dipropylene glycol, polyethylene glycol, polypropylene glycol, and polytetramethylene ether glycol); C4-C36 alicyclic diols (e.g., 1,4-cyclohexanedimethanol, and hydrogenated bisphenol A); adducts of alkylene oxide (hereinafter may be abbreviated as "AO") [e.g., ethylene oxide (hereinafter may be abbreviated as "EO"), propylene oxide (hereinafter may be abbreviated as "PO"), and butylene oxide (hereinafter may be abbreviated as "BO")] of the above-listed alicyclic diols (the number of moles added: 1 to 30); AO (e.g., EO, PO, and BO) adducts of bisphenols (e.g., bisphenol A, bisphenol F, and bisphenol S) (the number of moles added: 2 to 30); polylactone diols (e.g., poly-∈-caprolactone diol); and polybutadiene diol.

Examples of optionally used trihydric to octahydric or higher alcohol component include C3-C36 trihydric to octahydric or higher polyhydric aliphatic alcohols [e.g., alkane polyol and an intramolecular or intermolecular dehydration product thereof (e.g., glycerin, trimethylol ethane, trimethylol propane, pentaerythritol, sorbitol, sorbitan, and polyglycerin); sugars and derivatives thereof (e.g. sucrose and methyl glucoside)]; AO adduct of trisphenols (e.g. trisphenol PA) (the number of moles added: 2 to 30); AO adduct of a novolak resin (e.g. phenol novolak and cresol novolak) (the number of moles added: 2 to 30); acryl polyol (e.g., a copolymer of hydroxyethyl (meth)acrylate and other vinyl-based monomer). Among them, the trihydric to octahydric or higher aliphatic polyhydric alcohol, and AO adduct of the novolak resin are preferable, and AO adduct of the novolak resin is more preferable.

—Dicarboxylic Acid Component—

The dicarboxylic acid is not particularly limited and may be appropriately selected depending on the intended purpose, but is preferably aliphatic dicarboxylic acids and aromatic dicarboxylic acids.

Examples of the aliphatic dicarboxylic acid include a linear-chain aliphatic dicarboxylic acid, and a branched-chain dicarboxylic acid. Among them, the linear-chain aliphatic dicarboxylic acid is preferable.

Examples of the dicarboxylic acid component includes C4-C36 (preferably C4 to C12) alkane dicarboxylic acids (e.g., succinic acid, adipic acid, azelaic acid, sebacic acid, dodecanedioic acid, tetradecanedioic acid, hexadecanedioic acid, and octadecanedioic acid); C6-C40 alicyclic dicarboxylic acids (e.g., dimer acid such as dimeric linoleic acid); C4-C36 alkene dicarboxylic acids (e.g., maleic acid, fumaric acid, citraconic acid, and alkenyl succinic acids such as dodecenyl succinic acid, pentadecenyl succinic acid, octadecenyl succinic acid); C8-C36 (preferably C8 to C14) aromatic dicarboxylic acids (e.g., phthalic acid, isophthalic acid, terephthalic acid, t-butyl isophthalic acid, 2,6-naphthalene dicarboxylic acid, and 4,4'-biphenyl dicarboxylic acid).

Examples of optionally used trivalent to hexavalent or higher polycarboxylic acid components include C9-C20 aromatic polycarboxylic acids (e.g., trimellitic acid, and pyromellitic acid).

Note that, acid anhydrides, C1-C4 lower alkyl esters (e.g., methyl ester, ethyl ester, and isopropyl ester), or halides of those above-listed may be used as the dicarboxylic acid component or the trivalent to hexavalent or higher polycarboxylic acid component.

Among the above-listed dicarboxylic acids, the aliphatic dicarboxylic acid (preferably adipic acid, sebacic acid, dodecanedioic acid) is preferably used alone or in combination. A copolymer of the aliphatic dicarboxylic acid and the aromatic dicarboxylic acid (preferably terephthalic acid, isophthalic acid, t-butyl isophthalic acid, and lower alkyl esters thereof) is also preferably used. The amount of the aromatic dicarboxylic acid in the copolymer is preferably 50 mol % or less.

—Lactone Ring-Opening Polymerization Product—

The lactone ring-opening polymerization product as the crystalline polyester resin can be obtained by, for example, subjecting lactones (e.g., C3-C12 monolactone (having one ester group in a ring) such as β-propiolactone, γ-butyrolactone, δ-valerolactone, and ∈-caprolactone) to ring-opening polymerization using a catalyst (e.g., metal oxides, and an organic metal compounds). Among them, ∈-caprolactone is preferable in view of crystallinity.

The lactone ring-opening polymerization product may be a lactone ring-opening polymerization product containing a terminal hydroxyl group obtained by subjecting the lactones to ring-opening polymerization using glycols (e.g., ethylene glycol, and diethylene glycol) as an initiator. Moreover, terminals thereof may be modified to have a carboxyl group. The lactone ring-opening polymerization product may be commercially available products. Examples thereof include highly crystalline polycaprolactone such as H1P, H4, H5, and H7 of PLACCEL series (these products are of Daicel Corporation).

—Polyhydroxycarboxylic Acid—

The polyhydroxycarboxylic acid as the crystalline polyester resin can be obtained by a method in which hydroxycarboxylic acids such as glycolic acid, and lactic acid (e.g., L-lactic acid, D-lactic acid, and racemic lactic acid) is directly subjected to a dehydration-condensation reaction. However, a method in which C4-C12 cyclic ester (the number of ester groups in the ring is 2 to 3), which is equivalent to a dehydration-condensation product between 2 or 3 molecules of hydroxycarboxylic acid such as glycolide or lactide (e.g., L-lactide, D-lactide, and racemic lactide), is subjected to a ring-opening polymerization using a catalyst (e.g., metal oxides and an organic metal compounds) is preferable because of easiness in adjusting a molecular weight of the resultant. Among the cyclic esters listed above, L-lactide and D-lactide are preferable in view of crystallinity. Moreover, terminals of the polyhydroxycarboxylic acid may be modified to have a hydroxyl group or a carboxyl group.

—Divalent or Higher Valent Isocyanate Compound—

The divalent or higher valent isocyanate compound (divalent or higher valent isocyanate component) is not particularly limited and may be appropriately selected depending on the intended purpose. Examples thereof include divalent or higher valent aromatic isocyanates, divalent or higher valent aliphatic isocyanates, divalent or higher valent alicyclic isocyanates, divalent or higher valent aromatic aliphatic isocyanates, and modified products of the above-listed isocyanates. Among them, preferred are C6-C20 aromatic diisocyanates (the number of the carbon atoms excludes those contained in NCO groups, which is the same as follows), C2-C18 aliphatic diisocyanates, C4-C15 alicyclic diisocyanates, C8-C15 aromatic aliphatic diisocyanates, and modified products of the above-listed diisocyanates (e.g., modified products containing urethane group, carbodiimide group, allophanate group, urea group, biuret group, uretdione group, uretimine group, isocyanurate group, or oxazolidone group).

These may be used alone or in combination.

Examples of the aromatic isocyanates include 1,3-phenylene diisocyanate, 1,4-phenylene diisocyanate, 2,4-tolylenediisocyanate(TDI), 2,6-tolylenediisocyanate (TDI), crude TDI, 2,4'-diphenyl methane diisocyanate (MDI), 4,4'-diphenyl methane diisocyanate (MDI), crude MDI [a phosgenite product of crude diaminophenyl methane [a condensate between formaldehyde and aromatic amine (aniline) or a mixture thereof, or a mixture of diaminodiphenyl methane and a small amount (e.g., 5% by mass to 20% by mass) of trivalent or higher polyamine] polyallylpolyisocyanate (PAPI)], 1,5-naphthylene diisocyanate, 4,4',4"-triphenylmethane triisocyanate, m-p-isocyanatophenylsulfonyl isocyanate, and p-isocyanatophenylsulfonyl isocyanate.

Examples of the aliphatic isocyanates include ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethylcaproate, bis(2-isocyanatoethyl)fumarate, bis(2-isocyanatoethyl)carbonate, and 2-isocyanatoethyl-2,6-diisocyanatohexanoate.

Examples of the alicyclic isocyanates include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5-2,6-norbornanediisocyanate, and 2,6-norbornanediisocyanate.

Examples of the aromatic aliphatic isocyanate include m-xylene diisocyanate (XDI), p-xylene diisocyanate (XDI), and α,α,α',α'-tetramethylxylene diisocyanate (TMXDI).

Examples of the modified product of the diisocyanate include modified products containing a urethane group, carbodiimide group, allophanate group, urea group, biuret group, uretdione group, uretimine group, isocyanurate group, or oxazolidone group. Specific examples thereof include modified products of diisocyanate such as modified MDI (e.g., urethane-modified MDI, carbodiimide-modified MDI, and trihydrocarbylphosphate-modified MDI) and urethane-modified TDI, and a mixture of two or more of these modified products [e.g., a mixture of the modified MDI and the urethane-modified TDI (isocyanate-containing prepolymer)].

Among them, preferred are C6-C15 aromatic diisocyanate (the number of the carbon atoms excludes those contained in NCO groups, which is the same as follows), C4-C12 aliphatic diisocyanate, and C4-C15 alicyclic diisocyanate. More preferred are 2,4-tolylenediisocyanate, 2,6-tolylenediisocyanate, 2,4'-diphenylmethanediisocyanate, 4,4'-diphenylmethanediisocyanate, hexamethylenediisocyanate, dicyclohexylmethan-4,4'-diisocyanate, and isophorone diisocyanate.

—Urea-Modified Crystalline Polyester Resin—

The urea-modified crystalline polyester resin can be obtained, for example, through a reaction of a crystalline polyester resin having a terminal isocyanate group with an amine compound, or a reaction of a crystalline polyester resin having a terminal isocyanate group with water.

The urea-modified crystalline polyester resin can be obtained, in a toner producing process, by reacting a crystalline resin precursor having a functional group reactive with an active hydrogen group at an end thereof with a resin having an active hydrogen group or a compound such as a crosslinking agent and elongating agent having an active hydrogen group so as to increase the molecular weight thereof. Specifically, the urea-modified crystalline polyester resin can be obtained, in a toner producing process, through a reaction of a crystalline polyester resin having a terminal isocyanate group with an amine compound, or a reaction of a crystalline polyester resin having a terminal isocyanate group with water.

—Amine Compound—

The amine compound is not particularly limited and may be appropriately selected depending on the intended purpose. Examples thereof include aliphatic amines, and aromatic amines. Among them, C2-C18 aliphatic diamines, and C6-C20 aromatic diamines are preferable. Trivalent or higher amines may be used in combination, if necessary.

Examples of the C2-C18 aliphatic diamines include C2-C6 alkylene diamine (e.g., ethylene diamine, propylene diamine, trimethylene diamine, tetramethylene diamine, and hexamethylene diamine); C4 to C18 polyalkylenediamine [e.g., diethylenetriamine, iminobispropylamine, bis(hexamethylene)triamine, triethylenetetramine, tetraethylenepentamine and pentaethylenehexamine]; C1-C4 alkyl or C2-C4 hydroxyalkyl substitution products thereof (e.g., dialkylaminopropylamine, trimethylhexamethylene diamine, aminoethylethanolamine, 2,5-dimethyl-2,5-hexamethylene diamine, and methyl iminobispropyl amine); alicycle- or heterocycle-containing aliphatic diamine [e.g., C4-C15 alicyclic diamine (e.g., 1,3-diaminocyclohexane, isophorone diamine, menthane diamine, and 4,4'-methylene dichlorohexane diamine (hydrogenated methylene dianiline)) and C4-C15 heterocyclic diamine (e.g., piperazine, N-aminoethyl piperazine, 1,4-diaminoethyl piperazine, 1,4-bis(2-amino-2-methylpropyl) piperazine, 3,9-bis(3-aminopropyl)-2,4,8,10-tetraoxaspiro[5,5]undecane)]; and C8-C15 aromatic ring-containing aliphatic amines (e.g., xylylene diamine, and tetrachlor-p-xylylene diamine).

Examples of the C6-C20 aromatic diamines include unsubstituted aromatic diamine [e.g., 1,2-phenylenediamine, 1,3-phenylenediamine, 1,4-phenylenediamine, 2,4'-diphenyl methanediamine, 4,4'-diphenyl methanediamine, crude diphenyl methanediamine (e.g., polyphenyl polymethylene polyamine), diaminodiphenyl sulfone, benzidine, thiodianiline, bis(3,4-diaminophenyl)sulfone, 2,6-diaminopyridine, m-aminobenzylamine, triphenylmethane-4,4',4"-triamine, and naphthylene diamine]; aromatic diamine containing a C1-C4 nuclear substituted alkyl group [e.g., 2,4-tolylenediamine, 2,6-tolylenediamine, crude tolylenediamine, diethyltolylenediamine, 4,4'-diamino-3,3'-dimethyldiphenyl methane, 4,4'-bis(o-toluidine), dianisidine, diaminoditolylsulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenyl methane, 3,5-diethyl-3'-methyl-2',4-diaminodiphenyl methane, 3,3'-diethyl-2,2'-diaminodiphenyl methane, 4,4'-diamino-3,3'-dimethyldiphenyl methane, 3,3',5,5'-tetraethyl-4,4'-diaminobenzophenone, 3,3',5,5'-tetraethyl-4,4'-diaminodiphenyl ether, and 3,3',5,5'-tetraisopropyl-4,4'-diaminodiphenylsulfone], mixtures thereof at various mixing ratios; aromatic diamine containing a nuclear substituted electron-withdrawing group (e.g., halogens such as Cl, Br, I, and F, alkoxy groups such as a methoxy group or ethoxy group, and nitro group) [e.g., methylenebis-o-chloroaniline, 4-chloro-o-phenylenediamine, 2-chlor-1,4-phenylenediamine, 3-amino-4-chloroaniline, 4-bromo-1,3-phenylenediamine, 2,5-dichlor-1,4-phenylenediamine, 5-nitro-1,3-phenylenediamine, 3-dimethoxy-4-aminoaniline; 4,4'-diamino-3,3'-dimethyl-5,5'-dibromo-diphenyl methane, 3,3'-dichlorobenzidine, 3,3'-dimethoxybenzidine, bis(4-amino-3-chlorophenyl)oxide, bis(4-amino-2-chlorophenyl)propane, bis(4-amino-2-chlorophenyl)sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4'-methylene bis(2-iodoaniline), 4,4'-methylenebis(2-bromoaniline), 4,4'-methylenebis(2-fluoroaniline), and 4-aminophenyl-2-chloroaniline]; aromatic diamine containing a secondary amino group [e.g., those in which some of all of primary amino groups of the unsubstituted aromatic diamine, aromatic diamine containing a C1-C4 nuclear substituted alkyl group, mixture of isomers thereof at various mixing ratios, and aromatic diamine containing a nuclear substituted electron-withdrawing group are substituted with secondary amino groups using lower alkyl groups such as a methyl group or ethyl group] [e.g., 4,4'-di(methylamino)diphenyl methane, and 1-methyl-2-methilamino-4-aminobenzene].

Examples of the trihydric or higher amine include polyamide polyamine [e.g., a low molecular weight polyamide polyamine obtained by condensation of dicarboxylic acid (e.g., dimer acid) and excess (2 moles or more per mole of acid) of polyamine (e.g., alkylene diamine and poly alkylene polyamine)] or polyether polyamine [e.g, a hydride of cyanoethylated product of polyetherpolyol (e.g., polyalkylene glycol)].

—Crystalline Polyurethane Resin—

Example of the crystalline polyurethane resin includes a polyurethane resin synthesized from a diol component and a diisocyanate component. A trihydric or higher alcohol component or a trivalent or higher isocyanate component may be used, if necessary.

Specific examples of the diol component, the diisocyanate component, the trihydric or higher alcohol component, and the trivalent or higher isocyanate component include those described above.

—Crystalline Polyurea Resin—

Example of the crystalline polyurea resin includes a polyurea resin synthesized from a diamine component and a diisocyanate component. A trivalent or higher amine component or a trivalent or higher isocyanate component may be use, if necessary.

Specific examples of the diamine component, the diisocyanate component, the trivalent or higher amine component, and the trivalent or higher isocyanate component include those described above.

The crystalline resin preferably has a ratio of a softening temperature as measured by an elevated flow tester to the maximum peak temperature of heat of fusion as measured by a differential scanning calorimeter (DSC) (softening temperature/maximum peak temperature of heat of fusion) of 0.8 to 1.55. When the ratio (softening temperature/maximum peak temperature of heat of fusion) is 0.80 to 1.55, the crystalline resin is sharply softened by heat.

Notably, the softening temperature can be measured by means of an elevated flow tester (e.g., CFT-500D, product of Shimadzu Corporation). Specifically, while 1 g of a sample is heated at the heating rate of 3° C./min, a load of 30 kg/cm$^2$ is applied by a plunger to extrude the sample from a nozzle having a diameter of 0.5 mm and length of 1 mm, during which an amount of descent of the plunger of the flow tester is plotted versus the temperature. The temperature at which half of the sample was flown out is determined as a softening temperature of the sample.

The maximum peak temperature of heat of fusion can be measured by means of a differential scanning calorimeter (DSC) (e.g., TA-60WS and DSC-60, these products are of Shimadzu Corporation). A sample to be measured for the maximum peak temperature of heat of fusion is subjected to the following pretreatment. Specifically, the sample is melted at 130° C., followed by cooling from 130° C. to 70° C. at the rate of 1.0° C./min. Next, the sample was cooled from 70° C. to 10° C. at the rate of 0.5° C./min. Then, the sample is measured for an endothermic-exothermic change by DSC during heating at the heating rate of 20° C./min. Based on this measurement, "endothermic or exothermic amount" is plotted versus "temperature" in a graph. In the graph, an endothermic peak temperature in a temperature range from 20° C. to 100° C. is determined as "Ta*". In the case where there are some endothermic peaks within the aforementioned temperature range, the temperature of the peak at which the endothermic amount is the largest is determined as Ta*. Thereafter, the sample is stored for 6 hours at the temperature that is (Ta*−10)° C., followed by storing for 6 hours at the temperature that is (Ta*−15)° C. Next, the sample is measured for the endothermic-exothermic change by means of DSC during cooling to 0° C. at the cooling rate of 10° C./min and then heating at the heating rate of 20° C./min to thereby draw a graph in the same manner as the above. In the graph, the temperature corresponding to the maximum peak of the endothermic-exothermic amount is determined as the maximum peak temperature of heat of fusion.

—Non-Crystalline Resin—

The non-crystalline resin is not particularly limited and may be appropriately selected depending on the intended purpose as long as it is non-crystalline. Examples thereof include homopolymer of styrene or substitution thereof (e.g., polystyrene and polyvinyl toluene); styrene copolymer (e.g., styrene-methyl acrylate copolymer, styrene-methacrylic acid copolymer, styrene-methyl methacrylate copolymer, styrene-butyl methacrylate copolymer, styrene-acrylonitrile copolymer, styrene-vinyl methyl ether copolymer, styrene-vinyl methyl ketone copolymer, styrene-butadiene copolymer, and styrene-maleic acid ester copolymer); a polymethyl methacrylate resin, a polybutyl methacrylate resin, a polyvinyl acetate resin, a polyethylene resin, a polyester resin, a polyurethane resin, an epoxy resin, a polyvinyl butyral resin, a polyacrylic acid resin, a rosin resin, a modified rosin resin, and the above-listed resins modified so as to contain a functional group reactive with an active hydrogen group. These may be used alone, or in combination.

An amount of the non-crystalline resin contained in the binder resin is not particularly limited and may be appropriately selected depending on the intended purpose.

<Compound Represented by General Formula (1)>

The toner contains a compound represented by the following General Formula (1):

$$C_nH_{2n+1}R \qquad \text{General Formula (1)}$$

In the General Formula (1), n is 8 to 22 and R is COOH, $NH_2$ or OH.

The compound represented by the General Formula (1) is believed to promote crystallization of the crystalline resin by increasing mobility of a molecular chain in the crystalline resin. This effect is believed to be further improved due to similarity of molecular structure. Therefore, the crystalline resin is preferably a crystalline polyester resin having a urethane bond, a urea bond, or both thereof.

The n is 8 to 22. When the n is less than 8, the resultant toner has unsatisfactory heat-resistant storage stability. When the n is more than 22, the resultant toner has unsatisfactory transferability. The n is preferably 9 to 20, more preferably 9 to 15 from the viewpoint of excellent in heat-resistant storage stability and transferability.

An alkyl chain in the compound represented by the General Formula (1) may be a linear chain or a branched chain. Among them, a linear alkyl chain is preferred.

An amount of the compound represented by the General Formula (1) contained in the toner is 0.01% by mass to 0.25% by mass, preferably 0.05% by mass to 0.10% by mass. When the amount is less than 0.01% by mass, the resultant toner has unsatisfactory transferability. When the amount is more than 0.25% by mass, the resultant toner has unsatisfactory heat-resistant storage stability. When the amount falls within the preferable range, it is advantageous in excellent heat-resistant storage stability and transferability.

<Other Ingredients>

The other ingredients are not particularly limited and may be appropriately selected depending on the intended purpose. Examples thereof include colorants, releasing agents, charg controling agents, and external additives.

—Colorant—

The colorant is not particularly limited and may be appropriately selected depending on the intended purpose. Examples thereof include black pigments, yellow pigments, magenta pigment, and cyan pigments. Among them, preferred are those containing yellow pigments, magenta pigment, or cyan pigments.

The black pigments are used in, for example, a black toner. Examples thereof include carbon black, copper oxide, manganese dioxide, aniline black, active carbon, non-magnetic ferrite, magnetite, nigrosine dyes, and black iron oxide.

The yellow pigments are used in, for example, a yellow toner. Examples thereof include C.I. pigment Yellow 74, 93, 97, 109, 128, 151, 154, 155, 166, 168, 180, and 185, NAPHTHOL YELLOW S, HANSA YELLOW (10G, 5G, G), cadmium yellow, yellow iron oxide, loess, chrome yellow, titan yellow, and polyazo yellow.

The magenta pigments are used in, for example, a magenta toner. Examples thereof include quinacridone pigments, monoazo pigments such as C.I. Pigment Red 48:2, 57:1, 58:2, 5, 31, 146, 147, 150, 176, 184, and 269. Also, the monoazo pigments may be used in combination with the quinacridone pigments.

The cyan pigments are used in, for example, a cyan toner. Examples thereof include Cu-phthalocyanine pigments, Zn-phthalocyanine pigments, and Al-phthalocyanine pigments.

An amount of the colorant contained in the toner is not particularly limited and may be appropriately selected depending on the intended purpose, but it is preferably 1 part by mass to 15 parts by mass, more preferably 3 parts by mass to 10 parts by mass relative to 100 parts by mass of the toner. When the amount is smaller than 1 part by mass, the resultant toner may be deteriorated in colorability. When the amount is greater than 15 parts by mass, the pigment is insufficiently dispersed in the toner, potentially leading to deterioration in colorability and electric property of the toner.

The colorant may be used as a masterbatch obtained by forming a composite with a resin. The resin used for producing the masterbatch or kneaded with the masterbatch is not particularly limited and may be appropriately selected depending on the intended purpose.

The masterbatch can be prepared by mixing and kneading with high shear the colorant with the resin for the masterbatch. In the mixing and kneading, an organic solvent may be used for improving interactions between the colorant and the resin. Moreover, the masterbatch can be prepared by a flashing method in which an aqueous paste containing water and a colorant is mixed and kneaded with a resin and an organic solvent to transfer the colorant to the resin, and then the water and the organic solvent are removed. This method is preferably used because a wet cake of the colorant is used as it is without drying. A high-shearing disperser (e.g., a three-roll mill) is preferably used for mixing and kneading.

—Releasing Agent—

The releasing agent is not particularly limited and may be appropriately selected depending on the intended purpose. Examples thereof include carbonyl group-containing wax, polyolefin wax, and a long chain hydrocarbon. These may be used alone, or in combination. Among them, the carbonyl group-containing wax is preferable.

Examples of the carbonyl group-containing wax include polyalkanoic acid ester, polyalkanol ester, polyalkanoic acid amide, polyalkyl amide, and dialkyl ketone.

Examples of the polyalkanoic acid ester include carnauba wax, montan wax, trimethylolpropane tribehenate, pentaerythritol tetrabehenate, pentaerythritol diacetate dibehenate, glycerin tribehenate, and 1,18-octadecanediol distearate.

Examples of the polyalkanol ester include tristearyl trimellitate, and distearyl maleate.

Examples of the polyalkanoic acid amide include dibehenyl amide.

Examples of the polyalkyl amide include trimellitic acid tristearyl amide.

Examples of the dialkyl ketone include distearyl ketone.

Among the above-listed carbonyl group-containing waxes, polyalkanoic acid ester is particularly preferable.

Examples of the polyolefin wax include polyethylene wax, and polypropylene wax.

Examples of the long chain hydrocarbon include paraffin wax, and Sasol wax.

A melting point of the releasing agent is not particularly restricted and may be appropriately selected according to purpose. It is preferably 50° C. to 100° C., and more preferably 60° C. to 90° C. When the melting point is less than 50° C., heat resistant storage stability may be adversely affected. When the melting point is more than 100° C., cold-offset may be likely to occur upon fixing at low-temperature.

The melting point of the releasing agent may be measured by means of a differential scanning calorimeter (TA-60WS and DSC-60, these products are of Shimadzu Corporation). At first, 5.0 mg of the releasing agent is placed in an aluminum container, and the container is placed on a holder unit and set in an electric furnace. Next, in a nitrogen atmosphere, it is heated from 0° C. to 150° C. at a heating rate of 10° C./min, cooled from 150° C. to 0° C. at a cooling rate of 10° C./min and then heated to 150° C. at a heating rate of 10° C./min, during which a DSC curve is measured. From the obtained DSC curve, the maximum peak temperature of heat of fusion in the second heating can be determined as the melting point using an analysis program in the DSC-60 system.

A melt viscosity of the releasing agent is preferably 5 mPa·sec to 100 mPa·sec, more preferably 5 mPa·sec to 50 mPa·sec, and particularly preferably 5 mPa·sec to 20 mPa·sec at 100° C. When the melt viscosity is less than 5 mPa·sec, releasability may be deteriorated. When the melt viscosity is more than 100 mPa·sec, hot-offset resistance and releasability at a low temperature may be deteriorated.

An amount of the releasing agent contained in the toner is not particularly limited and may be appropriately selected depending on the intended purpose. It is preferably 1 part by mass to 20 parts by mass, and more preferably 3 parts by mass to 10 parts by mass relative to 100 parts by mass of the toner. When the amount is less than 1 part by mass, hot-offset resistance may be deteriorated. When the amount is more than 20 parts by mass, heat resistant storage stability, charging property, transferability and stress resistance may be deteriorated.

—Charge Controlling Agent—

The charge controlling agent is not particularly limited and may be appropriately selected depending on the intended purpose. Examples thereof include a nigrosine dye, a triphenyl methane dye, a chromium-containing metal complex dye, a molybdic acid chelate pigment, a rhodamine dye, alkoxy amine, a quaternary ammonium salt (including a fluorine-modified quaternary ammonium salt), alkylamide, phosphor and a phosphor compound, tungsten and a tungsten compound, a fluorine-containing activator, a metal salt of salicylic acid, and a metal salt of salicylic acid derivative. Specific examples thereof include a nigrosine dye BONTRON 03, a quaternary ammonium salt BONTRON P-51, a metal-containing azo dye BONTRON S-34, an oxynaphthoic acid-based metal complex E-82, a salicylic acid-based metal complex E-84 and a phenol condensate E-89 (these products are of ORIENT CHEMICAL INDUSTRIES CO., LTD), a quaternary ammonium salt molybdenum complex TP-302 and TP-415 (these products are of Hodogaya Chemical K.K), LRA-901 and a boron complex LR-147 (these products are of Japan Carlit K.K.) These may be used alone or in combination.

An amount of the charge controlling agent contained in the toner is not particularly limited and may be appropriately selected depending on the intended purpose, but is preferably 0.01 parts by mass to 5 parts by mass, more preferably 0.02 parts by mass to 2 parts by mass, relative to 100 parts by mass of the toner. When the amount is smaller than 0.01 parts by mass, satisfactory charge rising property and charge amount cannot be attained, and toner image may be deteriorated. When the amount is greater than 5 parts by mass, chargeability of the resultant toner is so high that electrostatic suction force toward the developing roller may increase, potentially leading to poor flowability of the developer and low image density.

—External Additive—

The external additive is not particularly limited and may be appropriately selected depending on the intended purpose. Examples thereof include silica, a metal salt of fatty acid, metal oxide, hydrophobized titanium oxide, and fluoropolymer.

Examples of the metal salt of fatty acid include zinc stearate, and aluminum stearate.

Examples of the metal oxide include titanium oxide, aluminium oxide, tin oxide, and antimony oxide.

Examples of commercially available products of the silica include R972, R974, RX200, RY200, R202, R805, and R812 (these products are of Nippon Aerosil Co., Ltd.).

Examples commercially available products of the titanium oxide include P-25 (product of Nippon Aerosil Co., Ltd.); STT-30 and STT-65C-S (both products are of Titan Kogyo, Ltd.); TAF-140 (product of Fuji Titanium Industry Co., Ltd.); and MT-150W, MT-500B, MT-600B, and MT-150A (these products are of TAYCA CORPORATION).

Examples of the hydrophobized titanium oxide include T-805 (product of Nippon Aerosil Co., Ltd.); STT-30A and STT-65S-S (both products are of Titan Kogyo, Ltd.); TAF-500T and TAF-1500T (both products are of Fuji Titanium Industry Co., Ltd.); MT-100S and MT-100T (both products are of TAYCA CORPORATION); and IT-S (product of ISHIHARA SANGYO KAISHA, LTD.).

Example of a hydrophobizing method includes a method in which hydrophilic particles are treated with a silane coupling agent such as methyltrimethoxy silane, methyltriethoxy silane, and octyltrimethoxy silane.

An amount of the external additive contained in the toner is not particularly limited and may be appropriately selected depending on the intended purpose, but is preferably 0.1 parts by mass to 5 parts by mass, more preferably 0.3 parts by mass to 3 parts by mass, relative to 100 parts by mass of the toner.

The average particle diameter of primary particles of the external additive is not particularly limited and may be appropriately selected depending on the intended purpose, but is preferably 1 nm to 100 nm, more preferably 3 nm to 70 nm. When the average particle diameter is smaller than 1 nm, the external additive is embedded into the toner particles, and therefore the external additive may not effectively function. When the average particle diameter is greater than 100 nm, the external additive may unevenly damage a surface of a photoconductor.

As for viscoelasticity of the toner, a storage elastic modulus at 70° C. [G' (70)] is not particularly limited and may be appropriately selected depending on the intended purpose. It is preferably $5.0\times10^4$ Pa≤G' (70)≤$5.0\times10^5$ Pa. When the [G' (70)] is less than $5.0\times10^4$ Pa, the image intensity immediately after fixing is decreased, potentially leading to a scratch on an image surface. When the [G' (70)] is more than $5.0\times10^5$ Pa, the resultant toner insufficiently melts upon fixing at low-temperature, which may deteriorate low-temperature fixing property.

A storage elastic modulus at 160° C. [G' (160)] is not particularly limited and may be appropriately selected depending on the intended purpose. It is preferably $1.0\times10^3$ Pa≤G' (160)≤$1.0\times10^4$ Pa. When the [G' (160)] is less than $1.0\times10^3$ Pa, the resultant toner may be deteriorated in hot-offset resistance. When the [G' (160)] exceeds $1.0\times10^4$ Pa, the resultant image may be deteriorated in glossiness.

A ratio (Tsh 2nd/Tsh 1st) of a shoulder temperature of a peak of heat of fusion in the first heating (Tsh 1st) and a shoulder temperature of a peak of heat of fusion in the second heating (Tsh 2nd) in the measurement of the toner by the differential scanning calorimetry (DSC) is not particularly limited and may be appropriately selected depending on the intended purpose, but is preferably 0.90 to 1.10, more preferably 0.90 to 1.05. When the ratio is less than 0.90, low-temperature fixing property may be deteriorated.

A volume average particle diameter is not particularly limited and may be appropriately selected depending on the intended purpose, but is preferably 3.0 μm to 10.0 μm, more preferably 4.0 μm to 7.0 μm. When the volume average particle diameter is less than 3.0 μm, in the case of the two-component developer, toner particles are fused to carrier surfaces after a long-term stirring in a developing device, which may deteriorate charging ability of the carrier. When the volume average particle diameter is more than 10.0 μm, a having high-resolution and high-quality image is difficult to be obtained and there may be great variation in the particle size of the toner when the toner is consumed and supplied repeatedly.

An average circularity of the toner is not particularly limited and may be appropriately selected depending on the intended purpose, but is preferably 0.950 to 0.980, more preferably 0.960 to 0.975. Also, a percentage of particles having the average circularity of less than 0.950 is preferably 15% by mass or less. When the average circularity is less than 0.950, satisfactory transferability or high-quality images with no dust cannot be achieved in some cases. When the average circularity is more than 0.980, cleaning failures occur on the photoconductor and the transfer belt in an image forming system employing blade cleaning technique, potentially leading to smear on the images. When forming an image having a high image occupation rate such as a photographic image, a paper-feeding failure causes an untransferred toner to accumulate on the photoconductor as residual toner after transfer, potentially leading to background smear on images. Alternatively, a charging roller that contact-charges the photoconductor is contaminated whereby a charging roller cannot exert their intrinsic chargeability in some cases.

As a result of intensive studies, the present inventors have found that, for a toner containing as a binder resin of which main component is a crystalline resin, a property that viscoelasticity degrades rapidly above a melting point (sharp melting property), which had been conventionally considered as effective for low-temperature fixing property, causes a large variation in a fixing temperature range depending on a type of paper. Thus, the present inventors have found that fixing at a constant temperature and a constant speed is possible regardless of a type of paper by using a toner which includes more than a certain amount of a component having a relatively high molecular weight for that of a conventional binder resin used in a toner with excellent low-temperature fixing property, specifically a component having a molecular weight of 100,000 or greater in terms of polystyrene measured by gel permeation chromatography (GPC), and which has a weight-average molecular weight within a certain range.

A tetrahydrofuran soluble content of the toner includes, on a peak area basis, preferably 5.0% or more, more preferably 7.0% or more, particularly preferably 9.0% or more of a component having a molecular weight of 100,000 or greater in a molecular weight distribution measured by gel permeation chromatography. When the content of the component having a molecular weight of 100,000 or greater is, on a peak area basis, 5.0% or more, fluidity and viscoelasticity of the toner after melting is less temperature-dependent, and the fluidity and the viscoelasticity of the toner during fixing is not significantly different between thin paper in which heat is easily transferred and thick paper in which heat is not easily transferred. Thus, it is possible in a fixing device to fix at a constant temperature and a constant speed. When the content of the component having a molecular weight of 100,000 or greater is, on a peak area basis, less than 5.0%, the fluidity and the viscoelasticity of the toner after melting greatly varies depending on a temperature. Thus, upon fixing on thin paper, for example, the toner is excessively deformed, causing an increase of an adhesion area to a fixing member. As a result, the toner may not be released well from the fixing member, causing paper wrapping.

A reason for the effect described above is considered as follows. A crystalline resin has a sharp melting property as described above, but internal cohesion and viscoelasticity of the toner in a molten state is highly dependent on a molecular weight and a structure of the resin. For example, when the crystalline resin contains a urethane bond or a urea bond as a linking group having a large cohesive force, it behaves similarly to a rubber-like elastic material at a relatively low temperature even during melting. However, because a thermal kinetic energy of the polymer chain increases as the temperature increases, the cohesion between the bonds loosens, and the resin gradually approaches a viscous body.

When such a resin is used as a binder resin for a toner, fixing at a low temperature may be performed without problems. However, when the fixing temperature increases, a so-called hot-offset phenomenon in which an upper portion of a toner image adheres to a fixing member during fixing due to small internal cohesive force during toner melting may occur, which may cause severely impairing image quality. When the urethane bond or the urea bond is increased to avoid hot-offset, fixing at a high temperature may be performed without problems. On the other hand, fixing at a low temperature results in low image glossiness and insufficient melt impregnation into paper, so that the image is easily exfoliated from the paper. Especially when fixing on paper which is thick and has many irregularities on a surface thereof, a fixing state may deteriorate due to low heat transfer efficiency of the toner during fixing. Also, for the toner in an elastic state, the fixing state of the toner significantly deteriorates due to an insufficient pressure applied to the toner in a fixing member in recess portions.

When a molecular weight is considered as a means to control viscoelasticity after melting, a higher molecular weight naturally has a higher viscoelasticity due to more obstacles to a movement of a molecular chain. Also, the molecular chain having a high molecular weight tends to tangle, and as a result, it behaves like an elastic body. Considering a fixing property on paper, the binder resin has preferably a lower molecular weight due to a lower viscosity upon melting, but hot offset occurs unless the binder resin has a certain degree of elasticity. However, when the molecular weight of the binder resin is totally increased, fixing property is deteriorated, and the fixing state deteriorates especially in the case of thick paper due to a low heat transfer efficiency to a toner. Thus, when the binder resin contains a crystalline component having a high molecular weight while the overall molecular weight of the binder resin is not increased too much, a toner can be obtained which has a favorably controlled viscoelasticity after melting and which may be fixed at a constant temperature and a constant speed regardless of a type of paper such as thin paper and thick paper.

The weight average molecular weight of the tetrahydrofuran soluble content of the toner is not particularly limited and may be appropriately selected depending on the intended purpose, but is preferably 20,000 to 70,000, more preferably 30,000 to 60,000, particularly preferably 35,000 to 50,000. When the weight-average molecular weight is greater than 70,000, the overall molecular weight of the binder resin is so high that fixing property is degraded, resulting in low glossiness and missing image after fixing due to external stress. When the weight-average molecular weight is less than 20,000, internal cohesion during toner melting decreases too much even though many high-molecular weight components are contained, resulting in hot offset and paper winding around a fixing member.

Examples of a method for obtaining a toner including the binder resin having the above-described molecular weight distribution include a method in which two or more types of resins having different molecular weight distributions are used in combination or a method in which a resin of which molecular weight distribution has been controlled during polymerization is used.

When two or more types of resins having different molecular weight distributions are used in combination, at least two types of resins having a relatively high molecular weight and a relatively low molecular weight are used. As the resin having a relatively high molecular weight, a resin which has a high molecular weight in advance may be used, or a high-molecular weight body may be formed by elongating a modified resin having a terminal isocyanate group in a toner producing process. The latter is preferable because it allows the high-molecular weight body to distribute uniformly in the toner. Also, in a producing method including a step of dissolving a binder resin in an organic solvent, the latter is dissolved easier than the resin having a high molecular weight in advance.

When the binder resin contains two types of resins: a resin having a high molecular weight (including a modified resin having a terminal isocyanate group) and a resin having a low molecular weight, a mass ratio of the resin having a high molecular weight to the resin having a low molecular weight (a high molecular weight resin/a low molecular weight resin) is preferably 5/95 to 60/40, more preferably 8/92 to 50/50, further preferably 12/88 to 35/65, particularly preferably 15/85 to 25/75. When the mass ratio of the high molecular weight resin is less than 5/95 or the mass ratio of the high molecular weight resin is more than 60/40, it may be difficult to obtain a toner which contains a binder resin having the above described molecular weight distribution.

When the resin of which molecular weight distribution has been controlled during polymerization is used, the resin can be obtained by adding to a bifunctional monomer a small amount of monomer having a different number of functional groups to thereby widen the molecular weight distribution, in the case of a polymerization manner such as polycondensation, polyaddition or addition condensation. Examples of the monomer having a different number of functional groups include tri functional or higher functional monomer and a mono-functional monomer. However, the tri functional or higher functional monomer results in a branched structure, so that it may be difficult to form a crystalline structure in the case of using a resin having crystallinity. When using the mono-functional monomer, polymerization reaction is terminated by the mono-functional monomer. Thus, in the case of using two or more types of resins, a low-molecular weight resin is produced while the polymerization reaction proceeds partly to form a high-molecular weight component.

The high-molecular weight components are needed to have a resin structure similar to the entire binder resin. That is, when the binder resin has crystallinity, the high-molecular weight components also should have crystallinity. On the other hand, when the high-molecular weight components have a structure largely different from the other resin components, the high-molecular weight components easily undergo a layer separation to be in a sea-island state, so that they may not be expected to contribute to improvements in viscoelasticity and cohesive force of the entire toner.

Therefore, the ratio [ΔH(H)/ΔH(T)] of an endothermic amount [ΔH(H), (J/g)] of an insoluble content of the toner to a mixed solution of tetrahydrofuran and ethyl acetate [tetrahydrofuran/ethyl acetate=50/50 (mass ratio)] in differential scanning calorimetry to an endothermic amount [ΔH(T), (J/g)] of the toner in the differential scanning calorimetry is preferably 0.20 to 1.25, more preferably 0.30 to 1.00, particularly preferably 0.40 to 0.80.

The ratio [ΔH(H)/ΔH(T)] indicate a ratio of the crystalline structure in the high-molecular weight components and the crystalline structure of the entire binder resin.

The insoluble content of the toner to a mixed solution of tetrahydrofuran (THF) and ethyl acetate (mixing ratio: 50:50 on a mass basis) can be obtained as follows. Specifically, a toner (0.4 g) is added to the mixed solution (40 g) at ambient temperature (20° C.), and shaken and mixed for 20 min, followed by allowing an insoluble content to be precipitated by a centrifuge, removing a supernatant, and vacuum drying.

A ratio [C/(A+C)] of (C) integrated intensity of a spectrum derived from a crystalline structure to a sum of the (C) and (A) integrated intensity of a spectrum derived from a non-crystalline structure in a diffraction spectrum of the toner obtained by X-ray diffraction measurement is preferably 0.15 or more, more preferably 0.20 or more, further preferably 0.30 or more, particularly preferably 0.45 or more.

Notably, the toner of the present invention contains wax, there is a high possibility of occurrence of a diffraction peak characteristic of the wax at the position of 2θ=23.5° to 24°. However, when an amount of the wax is 15% by mass or less relative to the total amount of the toner, the diffraction peak characteristic of the wax may not be considered because of its small contribution. When an amount of the wax is more than 15% by mass relative to the total amount of the toner, the "(C) integrated intensity of a spectrum derived from a crystalline structure in a binder resin" is replaced by a value which is calculated by subtracting integrated intensity of a spectrum derived from a crystalline structure of the wax from integrated intensity of a spectrum derived from a crystalline structure of the binder resin.

The volume resistivity (logR) of the toner is not particularly limited and may be appropriately selected depending on the intended purpose, but is preferably 10.5 to 12.0, more preferably 10.5 to 11.5. When the volume resistivity (logR) is less than 10.5, transferability may be deteriorated. When the volume resistivity (logR) is more than 12.0, transferability may be deteriorated. When the volume resistivity (logR) falls within the above more preferable range, it is advantageous in excellent transferability.

<<Molecular Weight>>

The molecular weight distribution and the weight average molecular weight (Mw) of a tetrahydrofuran soluble content of a toner and a resin can be measured by means of a gel permeation chromatography (GPC) measuring device (e.g., HLC-8220GPC, product of Tosoh Corporation). As a column, TSK-GEL SUPER HZM-H 15 cm in triplicate (product of Tosoh Corporation) is used. A resin to be measured is dissolved in tetrahydrofuran (THF) (including a stabilizer, product of Wako Pure Chemical Industries, Ltd.) to prepare a 0.15% by mass solution, followed by filtering through a 0.2 μm filter. The resultant filtrate is used for a sample. The sample solution in THF (100 μL) is injected to the measuring device, and measured at a flow rate of 0.35 mL/min under an environment of 40° C.

The molecular weight of the sample is calculated using a calibration curve drawn from monodispersed polystyrene standard samples. As the monodispersed polystyrene standard samples, SHOWDEX STANDARD series (product of Showa Denko K.K.) and toluene are used. The following 3 types of solutions of monodispersed polystyrene standard samples in THF are prepared and measured under the above conditions, and a calibration curve is drawn with a retention time of peak top as a light scattering molecular weight of the monodispersed polystyrene standard samples.

Solution A: S-7450 2.5 mg, S-678 2.5 mg, S-46.5 2.5 mg, S-2.90 2.5 mg, THF 50 mL Solution B: S-3730 2.5 mg, S-257 2.5 mg, S-19.8 2.5 mg, S-0.580 2.5 mg, THF 50 mL Solution C: S-1470 2.5 mg, S-112 2.5 mg, S-6.93 2.5 mg, toluene 2.5 mg, THF 50 mL A RI (refractive index) detector is used as a detector.

The above method was used in Examples described below.

A percentage of the components having a molecular weight of 100,000 or greater may be calculated from an intersection of the molecular weight of 100,000 with an integral molecular weight distribution curve.

<<Volume Resistivity>>

The volume resistivity can be measured as follows.

A measurement sample is produced by molding 3 g of the toner into pellets having a diameter of 40 mm and a thickness of 2 mm using an automatic pellet molding device (Type M No. 50 BRP-E; product of MAEKAWA TESTING MACHINE CO.) under the following conditions: a load: 6 t and pressing time: 1 min. The sample is set in SE-70 solid-state electrodes (product of Ando Electric Co., Ltd.), and logR when an alternating current of 1 kHz is applied between the electrodes is measured using a measurement device composed of TR-10C dielectric loss measuring instrument, WBG-9 oscillator and BDA-9 equilibrium point detector (all product of Ando Electric Co., Ltd.), and thereby the volume resistivity logR of the toner is determined. The RATIO is $1\times10^{-9}$. The measurement is performed under an environment of 25° C. (room temperature) and 50% RH.

<<Storage Elastic Modulus [G' (70)] and Storage Elastic Modulus [G' (160)]>>

The storage elastic modulus at 70° C. [G' (70)] and the storage elastic modulus at 160° C. [G' (160)] of the toner can be measured as follows.

The measurement is performed using a dynamic viscoelasticity measuring device (for example, ARES, product of TA Instruments, Inc.). A sample is formed into pellets having a diameter of 8 mm and a thickness of 1 mm to 2 mm, fixed on a parallel plate having a diameter of 8 mm, which is then stabilized at 40° C., and heated to 200° C. at a heating rate of 2.0° C./min with a frequency of 1 Hz (6.28 rad/s) and a strain amount of 0.1% (strain amount control mode), and a measurement is taken.

<<Tsh 2nd/Tsh 1st>>

A ratio (Tsh 2nd/Tsh 1st) of a shoulder temperature of a peak of heat of fusion in the first heating (Tsh 1st) and a shoulder temperature of a peak of heat of fusion in the second heating (Tsh 2nd) in the measurement of the toner by a differential scanning calorimetry (DSC) can be measured as follows.

The measurement is performed using a differential scanning calorimeter (e.g., TA-60WS and DSC-60, product of Shimadzu Corporation). At first, 5.0 mg of the toner is placed in an aluminum container, and the container is placed on a holder unit and set in an electric furnace. Next, in a nitrogen atmosphere, it is heated from 0° C. to 150° C. at a heating rate of 10° C./min, cooled from 150° C. to 0° C. at a cooling rate of 10° C./min and then heated to 150° C. at a heating rate of 10° C./min, during which a DSC curve is measured. In the DSC curve, an endothermic peak temperature in the first heating is determined as Tm 1st and an endothermic peak temperature in the second heating is determined as Tm 2nd. In a case in which multiple endothermic peaks are observed in each DSC curve, a peak having the maximum endothermic amount is selected. An intersection of the lower-temperature-side baseline with the tangent line of the lower-temperature-side slope of each selected endothermic peak is determined. The temperatures at the intersections in the first and second DSC curves are determined as Tsh 1st and Tsh 2nd, respectively.

<<Volume Average Particle Diameter>>

The volume average particle diameter of the toner can be measured as follows.

The volume average particle diameter of the toner is measured using a particle size analyzer (e.g., "MULTISIZER III," product of Beckman Coulter Co.) with the aperture diameter being set to 100 μm, and the obtained measurements are analyzed with an analysis software (Beckman Coulter Multisizer 3 Version 3.51). Specifically, a 10% by mass surfactant (alkylbenzene sulfonate, NEOGEN SC-A, product of Daiichi Kogyo Seiyaku Co.) (0.5 mL) is added to a 100 mL-glass beaker, and a toner (0.5 g) is added thereto, followed by stirring with a microspartel. Subsequently, ion-exchanged water (80 mL) is added to the beaker, and the obtained dispersion liquid is dispersed with an ultrasonic wave disperser (W-113MK-II, product of Honda Electronics Co.) for 10 min. The resultant dispersion liquid is measured using the above particle size analyzer MULTISIZER III and ISOTON III (product of Beckman Coulter Co.) serving as a solution for measurement. The dispersion liquid containing the toner sample is added dropwise so that the concentration indicated by the analyzer falls within a range of 8% by mass ±2% by mass.

In this method, it is important that the concentration is adjusted to 8% by mass ±2% by mass in terms of reproducibility in the particle diameter measurements. No measurement error in particle diameter is observed, as long as the concentration falls within the above range.

<<Average Circularity>>

The average circularity of the toner can be measured as follows.

The average circularity of the toner is measured by a flow-type particle image analyzer (FPIA-2100, product of SYSMEX CORPORATION), and the obtained data are analyzed using analysis software (FPIA-2100 DATA PROCESSING PROGRAM FOR FPIA Version 00-10). Specifically, a 10% by mass surfactant (alkylbenzene sulfonate, NEOGEN SC-A, product of Daiichi Kogyo Seiyaku Co.) (0.1 mL to 0.5 mL) is added to a 100 mL-glass beaker, and a toner (0.1 g to 0.5 g) is added thereto, followed by stirring with a microspartel. Subsequently, ion-exchanged water (80 mL) is added to the beaker, and the obtained dispersion liquid is dispersed with an ultrasonic wave disperser (product of Honda Electronics Co.) for 3 min. Using the FPIA-2100, the shape and distribution of toner particles are measured until the concentration of the dispersion liquid is in the range of 5,000 particles per microliter to 15,000 particles per microliter.

In this measuring method, it is important that the concentration of the dispersion liquid is adjusted to the range of 5,000 particles per microliter to 15,000 particles per microliter in terms of reproducibility in the average circularity measurements. To obtain the concentration of the dispersion liquid, it is necessary to change compositions of the dispersion liquid, that is, the amount of the surfactant added and the amount of the toner. The required amount of the surfactant varies depending upon the hydrophobicity of the toner. When the large amount of the surfactant is added, noise is caused by foaming. When the small amount of the surfactant is added, the toner cannot be sufficiently wetted, thereby leading to insufficient dispersion. Also, the amount of the toner added varies depending upon its particle diameter. The amount of the toner added needs to be small when the toner has a small particle diameter, and the amount of the toner added needs to be large when the toner has a large particle diameter. In the case where the particle diameter of the toner is in the range of 3 μm to 10 μm, addition of 0.1 g to 0.5 g of the toner makes it possible to adjust the concentration of the dispersion liquid to the range of 5,000 particles per microliter to 15,000 particles per microliter.

<<Amount of Crystalline Structure [C/(A+C)]>>

The ratio [C/(A+C)] is an index indicating an amount of a crystallization site in the toner (an amount of a crystallization site in a binder resin which is a major component of a toner), that is, an area ratio of a main diffraction peak derived from the crystalline structure to a halo derived from the non-crystalline structure in a diffraction spectrum obtained by an X-ray diffraction measurement. Notably, the ratio of a toner containing conventionally known crystalline resins or waxes in an amount similar to that of additives is less than about 0.15.

The X-ray diffraction measurement can be performed using an X-ray diffractometer equipped with a 2-dimensional detector (D8 DISCOVER with GADDS, product of Bruker Corporation).

As a capillary for the measurement, a mark tube (Lindemann glass) having a diameter of 0.70 mm is used. This capillary tube for the measurement is filled up with a sample with being tapped. The number of tapping is 100. Measurement conditions are described in detail below.

Tube current: 40 mA
Tube voltage: 40 kV
Goniometer 2θ axis: 20.0000°
Goniometer Ω axis: 0.0000°:
Goniometer ϕ axis: 0.0000°:
Detector distance: 15 cm (wide angle measurement)
Measuring range: 3.2≤2θ (°)≤37.2
Measurement time: 600 sec A collimator having a pinhole with a diameter of 1 mm is used for an incident optical system. The obtained 2-dimensional data are integrated with a supplied software (at 3.2° to 37.2° in the x-axis) and converted to a 1-dimensional data of a diffraction intensity and 2θ.

Figure 1B:
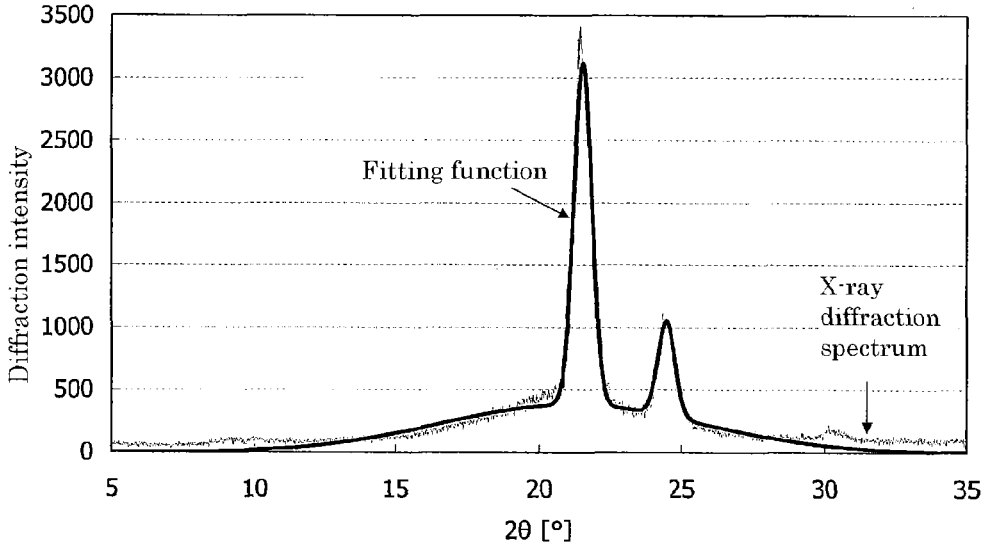
FIG. 1B is a diagram illustrating an example of a diffraction spectrum obtained by an X-ray diffraction measurement.

A method for calculating the ratio [C/(A+C)] based on the obtained X-ray diffraction measurement results now will be explained below. An example of a diffraction spectrum obtained by an X-ray diffraction measurement is illustrated in FIG. 1A and FIG. 1B. The horizontal axis represents 2θ, the vertical axis represents the X-ray diffraction intensity, and both of them are linear axes. In the X-ray diffraction spectrum illustrated in FIG. 1A, there are main peaks at 2θ=21.3° (P1) and 24.2° (P2), halos (h) are observed in a wide range including these two peaks. Here, the main peaks are derived from a crystalline structure of a binder resin, and the halos are derived from a non-crystalline structure.

These two main peaks and halos are expressed by a Gaussian functions:

$$f_{p1}(2\theta)=a_{p1}\exp\{-(2\theta-b_{p1})^2/(2c_{p1}^2)\} \quad \text{Equation A(1)}$$

$$f_{p2}(2\theta)=a_{p2}\exp\{-(2\theta-b_{p2})^2/(2c_{p2}^2)\} \quad \text{Equation A(2)}$$

$$f_h(2\theta)=a_h\exp\{-(2\theta-b_h)^2/(2c_h^2)\} \quad \text{Equation A(3)}$$

where $f_{p1}(2\theta)$, $f_{p2}(2\theta)$, and $f_h(2\theta)$ denote functions corresponding to the main peak P1, the main peak P2 and halos, respectively.

A sum of these functions:

$$f(2\theta)=f_{p1}(2\theta)+f_{p2}(2\theta)+f_h(2\theta) \quad \text{Equation A(4)}$$

is regarded as a fitting function of the overall X-ray diffraction spectrum (illustrated in FIG. 1B), which is fitted with a least square method.

There are 9 fitting variables: $a_{p1}$, $b_{p1}$, $c_{p1}$, $a_{p2}$, $b_{p2}$, $c_{p2}$, $a_h$, $b_h$ and $c_h$. As initial values of these fitting variable, peak positions of the X-ray diffraction were set for $b_{p1}$, $b_{p2}$ and $b_h$ (in the example of FIG. 1A, $b_{p1}$=21.3, $b_{p2}$=24.2, and $b_h$=22.5), and appropriate values are input for the other variables so that the two main peaks and halos coincide as much as possible with the X-ray diffraction spectrum. The fitting is carried out using SOLVER of Excel 2003 (product of Microsoft Corporation).

From the integrated areas ($S_{p1}$, $S_{p2}$, $S_h$) of the Gaussian functions $f_{p1}$ (2θ), $f_{p2}(2\theta)$ corresponding to the two main peaks (P1, P2) and Gaussian function $f_h(2\theta)$ corresponding to the halos after fitting, the ratio [C/(A+C)] as an index indicating the amount of the crystallization site can be calculated, assuming ($S_{p1}$+$S_{p2}$) was (C) and ($S_h$) was (A).

The toner can be suitably used in an image forming apparatus and an image forming method using an intermediate transfer medium.

<Production Method of Toner>

A production method of the toner is not particularly limited and may be appropriately selected depending on the intended purpose. Examples thereof include a kneading pulverization method and a method in which toner particles are granulated in an aqueous medium, which is so-called a chemical method.

Examples of the chemical method include a suspension polymerization method, an emulsification polymerization method, a seed polymerization method, and a dispersion polymerization method, all of which use a monomer as a starting material; a dissolution suspension method in which a resin or resin precursor is dissolved in an organic solvent, and the resulting solution is dispersed and/or emulsified in an aqueous medium; a method in which an oil phase composition containing a resin precursor having a functional group reactive with an active hydrogen group (a reactive group-containing prepolymer) is dispersed and/or emulsified in an aqueous medium to thereby react an active hydrogen group-containing compound with the reactive group-containing prepolymer in the aqueous medium (production method (I)); a phase-transfer emulsification method in which water is added to a solution containing a resin or resin precursor, and an appropriate emulsifying agent to thereby proceed phase transfer; and an aggregation method in which resin particles formed in any of the aforementioned methods is dispersed in an aqueous medium, and aggregated by, for example, heating and fusing to thereby granulate into particles having the predetermined size. Among them, the toner obtained by the dissolution suspension method, the production method (I), or the aggregation method is preferable from the viewpoint of granulation ability of the crystalline resin (e.g., easiness in control of particle size distribution, and control of particle shape), and the toner obtained by the production method (I) is more preferable.

These production methods will be specifically explained hereinafter.

—Kneading-Pulverization Method—

The kneading-pulverization method is a method for producing toner base particles, for example, by melt-kneading toner materials containing at least a binder resin, pulverizing and classifying.

The toner materials are mixed, and the resulting mixture is placed in a melt-kneader to perform melt-kneading. As the melt-kneader, for example, a single-screw or twin-screw continuous kneader, or a batch-type kneader with a roll mill can be used. Specific examples thereof include a KTT type twin screw extruder (product of KOBE STEEL, LTD.), a TEM type extruder (product of TOSHIBA MACHINE CO., LTD.), a twin screw extruder (product of KCK Engineering Co. Ltd), a PCM type twin screw extruder (product of Ikegai Corp.), and a co-kneader (product of Buss corporation). The melt-kneading is preferably performed under the appropriate conditions so as not to cause scission of molecular chains of the binder resin. Specifically, the temperature of the melt-kneading is adjusted under taking the softening point of the binder resin as consideration. When the temperature of the melt-kneading is greatly higher than the softening point, the scission occurs significantly. When the temperature is greatly lower than the softening point, the dispersion may not proceed.

The pulverizing is a step of pulverizing the kneaded product obtained by the melt-kneading. In the pulverizing, it is preferred that the kneaded product be coarsely pulverized, followed by finely pulverized. For the pulverizing, a method in which the kneaded product is pulverized by making the kneaded product to crush into an impact plate in the jet stream, a method in which the kneaded product is pulverized by making particles of the kneaded product to crush with each other in the jet stream, or a method in which the kneaded product is pulverized in a narrow gap between a mechanically rotating rotor and a stator is preferably used.

The classifying is a step of classifying the pulverized product obtained by the pulverizing into particles having the predetermined particle diameters. The classifying can be performed by removing the fine particles by means of, for example, a cyclone, a decanter, or a centrifugal separator.

—Chemical Method—

The chemical method is not particularly limited and may be appropriately selected depending on the intended purpose. It is preferably a method in which toner material liquid containing at least the binder resin is dispersed and/or emulsified into an aqueous medium to thereby granulate the toner base particles.

As the chemical method, preferred is a method in which an oil phase (toner material liquid), which is obtained by dissolving or dispersing toner materials containing at least the binder resin, the binder resin precursor, or both thereof into an organic solvent, is dispersed or emulsified into an aqueous medium to thereby granulate the toner base particles. In this case, in the aqueous medium, the binder resin precursor (resin precursor having a functional group reactive with an active hydrogen group) is reacted with an active hydrogen group-containing compound.

Examples of the active hydrogen group-containing compound include water and amine compounds. The amine compounds include an amine compound blocked with ketone (ketimine compound). Example of the amine includes those exemplified in a description of the urea-modified crystalline polyester resin.

Example of the binder resin precursor includes a crystalline polyester resin having a terminal isocyanate group.

The dissolution suspension method and the ester-elongating method allow the crystalline resin to be easily granulated.

—Organic Solvent—

As for the organic solvent used for dissolving or dispersing the binder resin or the binder resin precursor, a volatile organic solvent having a boiling point of lower than 100° C. is preferable because it can be easily removed in the subsequent step.

Examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethyl ketone, and methyl isobutyl ketone. These may be used alone, or in combination. Among them, preferred are ester-based solvents such as methyl acetate and ethyl acetate; aromatic solvents such as toluene and xylene; and the halogenated hydrocarbons such as methylene chloride, 1,2-dichloroethane, chloroform, and carbon tetrachloride.

The solid content concentration of the toner material liquid containing the binder resin or the binder resin precursor is preferably 40% by mass to 80% by mass. When the solid content concentration is less than 40% by mass, the amount of the resultant toner may be decreased. When the solid content concentration is more than 80% by mass, the binder resin or the binder resin precursor is difficult to be dissolved or dispersed, and is increased in viscosity to thereby be difficult to handle.

Toner materials other than resin (e.g., the colorant and the releasing agent, and masterbatch thereof) may be separately dissolved or dispersed into organic solvent, followed by mixing with the toner material liquid.

—Aqueous Medium—

As for the aqueous medium, water may be used alone, or water may be used in combination with a water-miscible solvent. Examples of the water-miscible solvent include alcohols (e.g., methanol, isopropanol, and ethylene glycol), dimethyl formamide, tetrahydrofuran, cellosolves (e.g., methyl cellosolve), and lower ketones (e.g., acetone, and methyl ethyl ketone).

An amount of the aqueous medium relative to 100 parts by mass of the toner material liquid is not particularly limited and may be appropriately selected depending on the intended purpose, but it is typically 50 parts by mass to 2,000 parts by mass, preferably 100 parts by mass to 1,000 parts by mass. When the amount is smaller than 50 parts by mass, the toner material liquid cannot be desirably dispersed, which enables to provide toner particles having the predetermined particle diameters. When the amount is greater than 2,000 parts by mass, it may not be economical.

An inorganic dispersant and/or organic resin particles may be dispersed in the aqueous medium in advance, which is preferable from the viewpoints of a sharp particle distribution of the resultant toner, and dispersion stability.

Examples of the inorganic dispersant include tricalcium phosphate, calcium carbonate, titanium oxide, colloidal silica and hydroxyapatite.

As for the resin for forming the organic resin particles, any resin can be used as long as it is a resin capable of forming an aqueous dispersant, and may be a thermoplastic resin or a thermosetting resin. Examples thereof include a vinyl resin, a polyurethane resin, an epoxy resin, a polyester resin, a polyamide resin, a polyimide resin, a silicon resin, a phenol resin, a melamine resin, a urea resin, an aniline resin, an ionomer resin, and a polycarbonate resin. These may be used alone, or in combination. Among them, a vinyl resin, a polyurethane resin, an epoxy resin, a polyester resin, and a combination thereof are preferable because an aqueous dispertant of spherical resin particles can be easily obtained.

The method for emulsifying and/or dispersing the toner material liquid into the aqueous medium is not particularly limited, and conventional equipment (e.g., a low-speed shearing disperser, a high-speed shearing disperser, a friction disperser, a high-pressure jetting disperser and ultrasonic disperser) can be employed. Among them, the high-speed shearing disperser is preferable from the viewpoint of miniaturizing size of particles. In the case of using the high-speed shearing disperser, the rotating speed is not particularly limited, but it is typically 1,000 rpm to 30,000 rpm, preferably 5,000 rpm to 20,000 rpm. The temperature during dispersing is typically 0° C. to 150° C. (under a pressure), preferably 20° C. to 80° C.

In the case where the toner material liquid contains the binder resin precursor, the active hydrogen group-containing compound, which is necessary for an elongation and/or crosslink reaction of the binder resin precursor, may be previously mixed in the toner material liquid before dispersing the toner material liquid in an aqueous medium, or may be mixed with the toner material liquid in the aqueous medium.

In order to remove the organic solvent from the obtained emulsified dispersion liquid, conventional known methods can be used. For example, a method can be employed in which the temperature of the entire system is gradually increased under normal pressure or reduced pressure, to completely evaporate and remove the organic solvent in the droplets. Thus, toner base particles can be obtained.

In washing and drying of the toner base particles dispersed in the aqueous medium, conventional known techniques are used. Specifically, after the solid-liquid separation is performed by a centrifugal separator or a filter press, the resulting toner cake is re-dispersed in ion-exchanged water at normal temperature to about 40° C., optionally adjusting the pH thereof with acid or alkali, followed by again subjected to solid-liquid separation. This series of operations are repeated a few times to remove impurities or a surfactant, followed by drying by means of a flash dryer, circulation dryer, vacuum dryer, or vibration flash dryer, to thereby obtain toner powder. Fine particle components may be removed from the toner by centrifugal separation during the aforementioned operations, or they may be optionally classified to have the desired particle size distribution by means of a conventional classifying device after the drying.

(Developer)

The developer of the present invention contains the toner of the present invention and preferably a carrier; and, if necessary, further contains other ingredients. The developer may be a one-component developer, or two-component developer which is obtained by mixed with a carrier, but is preferably a two-component developer from the viewpoint of a long service life in the case of being used in recent high-speed printers corresponded to the improved information processing speed.

In the case of the one-component developer using the toner, the diameters of the toner particles do not change largely even after the toner is supplied and consumed repeatedly; the toner does not cause filming to a developing roller, nor fuse to a layer thickness regulating member (e.g., a blade) for thinning a thickness of a layer of the toner; and excellent and stable developability can be achieved even when the toner is used (stirred) in the developing unit over a long period of time.

In the case of the two-component developer using the toner, the diameters of the toner particles do not change largely even after the toner is supplied and consumed repeatedly; and excellent and stable developability can be achieved even when the toner is stirred in the developing unit over a long period of time.

<Carrier>

The carrier is not particularly limited and may be appropriately selected depending on the intended purpose. It preferably includes a core material and a resin layer which coats the core material.

—Core Material—

The core material is not particularly limited and may be appropriately selected depending on the intended purpose as long as it is magnetic particles. Preferred examples thereof include ferrite, magnetite, iron and nickel. Also, in the case where environmental adaptability which is promoted significantly in recent years is taken into consideration, the ferrite preferably is not conventional copper-zinc ferrite, but manganese ferrite, manganese-magnesium ferrite, manganese-strontium ferrite, manganese-magnesium-strontium ferrite and lithium ferrite.

—Resin Layer—

A material of the resin layer is not particularly limited and may be appropriately selected depending on the intended purpose. Examples thereof include an amino resin, a polyvinyl resin, a polystyrene resin, a halogenated olefin resin, a polyester resin, a polycarbonate resin, a polyethylene resin, a polyvinyl fluoride resin, a polyvinylidene fluoride resin, a polytrifluoroethylene resin, a polyhexafluoropropylene resin, a copolymer of vinylidene fluoride and acryl monomer, a copolymer of vinylidene fluoride and vinyl fluoride, a fluoroterpolymer (e.g., a terpolymer of tetrafluoroethylene, vinylidene fluoride, and non-fluoromonomer), and a silicone resin. These may be used alone, or in combination.

The silicone resin is not particularly limited and may be appropriately selected depending on the intended purpose. Examples thereof include a straight silicone resin constituted of organosiloxane bonds; and a modified silicone resin modified with, for example, an alkyd resin, a polyester resin, an epoxy resin, an acryl resin, or a urethane resin.

The silicone resin may be commercially available products.

Examples of commercially available products of the straight silicone resin include KR271, KR255, and KR152 (these products are of Shin-Etsu Chemical Co., Ltd.); and SR2400, SR2406, and SR2410 (these products are of Dow Corning Toray Co., Ltd.).

Examples of commercially available products of the modified silicone resin include KR206 (alkyd-modified silicone resin), KR5208 (acryl-modified silicone resin), ES1001N (epoxy-modified silicone resin), and KR305 (urethane-modified silicone resin) (these products are of Shin-Etsu Chemical Co., Ltd.); and SR2115 (epoxy-modified silicone resin), SR2110 (alkyd-modified silicone resin) (these products are of Dow Corning Toray Co., Ltd.).

Note that, the silicone resin can be used alone, but the silicone resin can also be used in combination with, for example, a component capable of undergoing a crosslinking reaction or a component for adjusting charging amount.

An amount of an ingredient for forming the resin layer contained in the carrier is preferably 0.01% by mass to 5.0% by mass. When the amount is smaller than 0.01% by mass, the resin layer may not be uniformly formed on a surface of the core material. When the amount is greater than 5.0% by mass, the resin layer becomes so thick that particles of the carrier may be granulated with each other, and thus uniform carrier particles cannot be obtained.

In the case where the developer is a two-component developer, an amount of the toner is not particularly limited and may be appropriately selected depending on the intended purpose, but is preferably 2.0 parts by mass to 12.0 parts by mass, more preferably 2.5 parts by mass to 10.0 parts by mass relative to 100 parts by mass of the carrier.

(Image Forming Apparatus and Image Forming Method)

An image forming apparatus of the present invention includes at least an electrostatic latent image bearing member (hereinafter may be referred to as "photoconductor"), an electrostatic latent image forming unit, and a developing unit; and, if necessary, further includes other units.

An image forming method of the present invention includes at least an electrostatic latent image forming step and a developing step; and, if necessary, further includes other steps.

The image forming method can be suitably performed by the image forming apparatus of the present invention. Specifically, the electrostatic latent image forming step can be suitably performed by the electrostatic latent image forming unit. The developing step can be suitably performed by the developing unit. The other steps can be suitably performed by the other units.

<Electrostatic Latent Image Bearing Member>

The material, structure, size of the electrostatic latent image bearing member are not particularly limited and may be appropriately selected from those known in the art. Examples of the material of the electrostatic latent image bearing member include an inorganic photoconductor made of amorphous silicon or selenium and an organic photoconductor made of polysilane or phthalopolymethine. Among them, an amorphous silicon photoconductor is preferred from the viewpoint of a long service life.

The amorphous silicon photoconductor may be a photoconductor having a support and a photoconductive layer of a-Si, which is formed on the heated support of 50° C. to 400° C. using a film forming method such as a vacuum vapor deposition method, a sputtering method, an ion plating method, a thermal CVD (Chemical Vapor Deposition) method, a photo-CVD method or a plasma CVD method. Among them, a plasma CVD method is suitably employed, in which gaseous raw materials are decomposed through application of direct current or high-frequency or microwave glow discharge to thereby form an a-Si deposition film on the support.

The shape of the electrostatic latent image bearing member is not particularly limited and may be appropriately selected depending on the intended purpose, but is preferably cylindrical. The outer diameter of the electrostatic latent image bearing member is not particularly limited and may be appropriately selected depending on the intended purpose, but is preferably 3 mm to 100 mm, more preferably 5 mm to 50 mm, particularly preferably 10 mm to 30 mm.

<Electrostatic Latent Image Forming Unit and Electrostatic Latent Image Forming Step>

The electrostatic latent image forming unit is not particularly limited and may be appropriately selected depending on the intended purpose, as long as it is a unit configured to form an electrostatic latent image on the electrostatic latent image bearing member. Example thereof includes a unit including at least a charging member configured to charge a surface of the electrostatic latent image bearing member and an exposing member configured to imagewise-expose the surface of the electrostatic latent image bearing member.

The electrostatic latent image forming step is not particularly limited and may be appropriately selected depending on the intended purpose, as long as it is a step of forming an electrostatic latent image on the electrostatic latent image bearing member. For example, the electrostatic latent image forming step is performed with the electrostatic latent image forming unit by charging a surface of the electrostatic latent image bearing member, followed by imagewise-exposing the surface of the electrostatic latent image bearing member.

—Charging Member and Charging—

The charging member is not particularly limited and may be appropriately selected depending on the intended purpose. Examples thereof include contact-type chargers known per se having, for example, a electroconductive or semi-electroconductive roller, brush, film and rubber blade; and non-contact-type chargers utilizing corona discharge such as corotron and scorotron.

The charging can be performed by, for example, applying voltage to a surface of the electrostatic latent image bearing member using the charging member.

The charging member may have any shape such as a magnetic brush or a fur brush, as well as a roller. The shape thereof may be suitably selected according to the specification or configuration of the image forming apparatus.

When the magnetic brush is used as the charging member, the magnetic brush is composed of a charging member made of various ferrite particles such as Zn—Cu ferrite, a non-magnetic electroconductive sleeve configured to support the charging member, and a magnetic roller included in the non-magnetic electroconductive sleeve.

Also, when the fur brush is used as the charging member, the fur brush may be made of a fur which has been treated to be electroconductive with, for example, carbon, copper sulfide, a metal or a metal oxide, and which is formed into the charging member by coiling around or mounting to a metal or a metal core which has been treated to be electroconductive.

The charging member is not limited to the aforementioned contact-type charging members. However, the contact-type charging members are preferably used from the viewpoint of producing an image forming apparatus in which the amount of ozone generated from the charging member is reduced.

—Exposing Member and Exposing—

The exposing member is not particularly limited and may be appropriately selected depending on the purpose, as long as it can desirably imagewise-expose the surface of the electrostatic latent image bearing member which have been charged with the charging member. Examples of the exposing member include various exposing members such as a copy optical exposing member, a rod lens array exposing member, a laser optical exposing member and a liquid crystal shutter exposing member.

A light source used for the exposing member is not particularly limited and may be appropriately selected depending on the intended purpose. Examples thereof include conventional light-emitting devices such as a fluorescent lamp, a tungsten lamp, a halogen lamp, a mercury lamp, a sodium lamp, a light-emitting diode (LED), a laser diode (LD) and an electroluminescence (EL) device.

Also, various filters may be used for emitting only light having a desired wavelength range. Examples of the filters include a sharp-cut filter, a band-pass filter, an infrared cut filter, a dichroic filter, an interference filter and a color temperature conversion filter.

The exposing can be performing by, for example, imagewise-exposing the surface of the electrostatic latent image bearing member using the exposing member.

Notably, in the present invention, the back side of the electrostatic latent image bearing member may be imagewise exposed.

<Developing Unit and Developing Step>

The developing unit is not particularly limited and may be appropriately selected depending on the intended purpose, as long as it is a developing unit which contains a toner and is configured to develop the electrostatic latent image which has been formed on the electrostatic latent image bearing member to thereby form a visible image.

The developing step is not particularly limited and may be appropriately selected depending on the intended purpose, as long as it is a developing step of developing with a toner the electrostatic latent image which has been formed on the electrostatic latent image bearing member to thereby form a visible image. For example, the developing step is performed by the developing unit.

The developing unit may employ a dry developing system, or a wet developing system. The developing unit may be a developing unit for a single color, or a developing unit for multicolor.

The developing unit is preferably a developing device including a stirrer for rubbing and stirring the toner to charge the toner, a magnetic field generating unit fixed inside the device, and a rotatable developer bearing member for bearing a developer containing the toner on the surface thereof.

In the developing device, the toner and the carrier are stirred and mixed so that the toner is charged by friction generated therebetween. The charged toner is retained in the chain-like form on the surface of the rotating magnetic roller to form a magnetic brush. The magnetic roller is disposed in proximately to the electrostatic latent image bearing member and thus, some of the toner forming the magnetic brush on the magnet roller are electrically transferred onto the surface of the electrostatic latent image bearing member. As a result, the electrostatic latent image is developed with the toner to form a visible toner image on the surface of the electrostatic latent image bearing member.

<Other Units and Other Steps>

Examples of the other units include a transfer unit, a fixing unit, a cleaning unit, a charge-eliminating unit, a recycling unit, and a control unit.

Examples of the other steps include a transfer step, a fixing step, a cleaning step, a charge-eliminating step, a recycling step, and a control step.

—Transfer Step and Transfer Unit—

The transfer unit is not particularly limited and may be appropriately selected depending on the intended purpose, as long as it is a unit configured to transfer a visible image onto a recording medium. The transfer unit preferably has a primary transfer unit configured to transfer visible images onto an intermediate transfer medium to form a composite transfer image, and a secondary transfer unit configured to transfer the composite transfer image onto a recording medium.

The transfer step is not particularly limited and may be appropriately selected depending on the intended purpose, as long as it is a step of transferring a visible image onto a recording medium. In a preferred embodiment of the transfer step, a visible image is primarily transferred onto an intermediate transfer medium, from which the visible image is secondarily transferred onto the recording medium.

The transfer can be performed by, for example, charging the photoconductor using a transfer charger, and can be performed by the transfer unit.

Here, when the image to be secondarily transferred onto the recording medium is a color image of several color toners, a configuration can be employed in which the transfer unit sequentially superposes the color toners on top of another on the intermediate transfer medium to form an image on the intermediate transfer medium, and the image on the intermediate transfer medium is secondarily transferred at one time onto the recording medium by the intermediate transfer unit.

Notably, the intermediate transfer medium is not particularly limited and may be appropriately selected from known transfer media depending on the intended purpose. Preferred examples thereof include a transfer belt.

The transfer unit (the primary transfer unit and the secondary transfer unit) preferably has at least a transfer device which is configured to transfer the visible images which has been formed on the photoconductor onto the recording medium through peeling charge. Examples of the transfer device include a corona transfer device using corona discharge, a transfer belt, a transfer roller, a press transfer roller and an adhesion transfer device.

Notably, the recording medium is typically plane paper, but it is not particularly limited and may be appropriately selected depending on the intended purpose, so long as it can transfer an unfixed image after developing. PET bases for OHP can also be used as the recording medium.

—Fixing Step and Fixing Unit—

The fixing unit is not particularly limited and may be appropriately selected depending on the intended purpose as long as it is a unit configured to fix a transferred image which has been transferred on the recording medium, but is preferably known heating-pressurizing members. Examples thereof include a combination of a heat roller and a pressure roller, and a combination of a heat roller, a pressure roller and an endless belt.

The fixing step is not particularly restricted and may be appropriately selected according to purpose, as long as it is a step of fixing a visible image which has been transferred on the recording medium. The fixing step may be performed every time when an image of each color toner is transferred onto the recording medium, or at one time (at the same time) on a laminated image of color toners.

The fixing step can be performed by the fixing unit.

The heating-pressurizing member usually performs heating preferably at 80° C. to 200° C.

Notably, in the present invention, known photofixing devices may be used instead of or in addition to the fixing unit depending on the intended purpose.

A surface pressure at the fixing step is not particularly limited and may be appropriately selected depending on the intended purpose, but is preferably 10 $N/cm^2$ to 80 $N/cm^2$.

—Cleaning Unit and Cleaning Step—

The cleaning unit is not particularly limited and may be appropriately selected depending on the intended purpose, as long as it can remove the toner remaining on the photoconductor. Examples thereof include a magnetic brush cleaner, an electrostatic brush cleaner, a magnetic roller cleaner, a blade cleaner, a brush cleaner and a web cleaner.

The cleaning step is not particularly limited and may be appropriately selected depending on the intended purpose, as long as it is a step of removing the toner remaining on the photoconductor. It may be performed by the cleaning unit.

—Charge-Eliminating Unit and Charge-Eliminating Step—

The charge-eliminating unit is not particularly limited and may be appropriately selected depending on the intended purpose, as long as it is a unit configured to apply a charge-eliminating bias to the photoconductor to thereby charge-eliminate. Example thereof includes a charge-eliminating lamp.

The charge-eliminating step is not particularly limited and may be appropriately selected depending on the intended purpose, as long as it is a step of applying a charge-eliminating bias to the photoconductor to thereby charge-eliminate. It may be carried out by the charge-eliminating unit.

—Recycling Unit and Recycling Step—

The recycling unit is not particularly limited and may be appropriately selected depending on the intended purpose, as long as it is a unit configured to recycle the toner which has been removed at the cleaning step to the developing device. Example thereof includes a known conveying unit.

The recycling step is not particularly limited and may be appropriately selected depending on the intended purpose, as long as it is a step of recycling the toner which has been removed at the cleaning step to the developing device. The recycling step can be performed by the recycling unit.

—Control Unit and Control Step—

The control unit is not particularly limited and may be appropriately selected depending on the intended purpose, as long as it can control the operation of each of the above units. Examples thereof include devices such as sequencer and computer.

The control step is not particularly limited and may be appropriately selected depending on the intended purpose, as long as it is a step of controlling the operation of each of the above units. The control step can be performed by the control unit.

One embodiment for performing an image forming method by an image forming apparatus of the present invention now will be explained with reference to FIG. 2. An image forming apparatus 100 illustrated in FIG. 2 includes an electrostatic latent image bearing member 10, a charging roller 20 serving as the charging unit, an exposing device 30 serving as the exposing unit, a developing device 40 serving as the developing unit, an intermediate transfer belt 50, a cleaning device 60 serving as the cleaning unit which includes a cleaning blade and a charge-eliminating lamp 70 serving as the charge-eliminating unit.

The intermediate transfer belt 50 is an endless belt and designed so as to be movable in a direction indicated by an arrow by three rollers 51 which are disposed inside the belt and around which the belt is stretched. A part of the three rollers 51 also functions as a transfer bias roller which may apply a predetermined transfer bias (primary transfer bias) to the intermediate transfer medium 50. Also, a cleaning device 90 including a cleaning blade is disposed near the intermediate transfer medium 50. Further, a transfer roller 80 serving as the transfer unit which can apply a transfer bias for transferring (secondary transferring) a developed image (toner image) onto transfer paper 95 serving as a final recording medium is disposed facing the intermediate transfer medium. In addition, around the intermediate transfer medium 50, a corona charging device 58 for applying a charge to the toner image transferred on the intermediate transfer medium 50 is disposed between a contact portion of the electrostatic latent image bearing member 10 with the intermediate transfer medium 50 and a contact portion of the intermediate transfer medium 50 with the transfer paper 95 in a rotational direction of the intermediate transfer medium 50.

The developing device 40 includes a developing belt 41 serving as the developer bearing member; and a black developing unit 45K, a yellow developing unit 45Y, a magenta developing unit 45M and a cyan developing unit 45C which are arranged around the developing belt 41. Here, the black developing unit 45K includes a developer container 42K, a developer supply roller 43K and a developing roller 44K. The yellow developing unit 45Y includes a developer container 42Y, a developer supply roller 43Y and a developing roller 44Y. The magenta developing unit 45M includes a developer container 42M, a developer supply roller 43M and a developing roller 44M. The cyan developing unit 45C includes a developer container 42C, a developer supply roller 43C and a developing roller 44C. Also, the developing belt 41 is an endless belt which is rotatably stretched around a plurality of belt rollers and is partially in contact with the electrostatic latent image bearing member 10.

Figure 2:
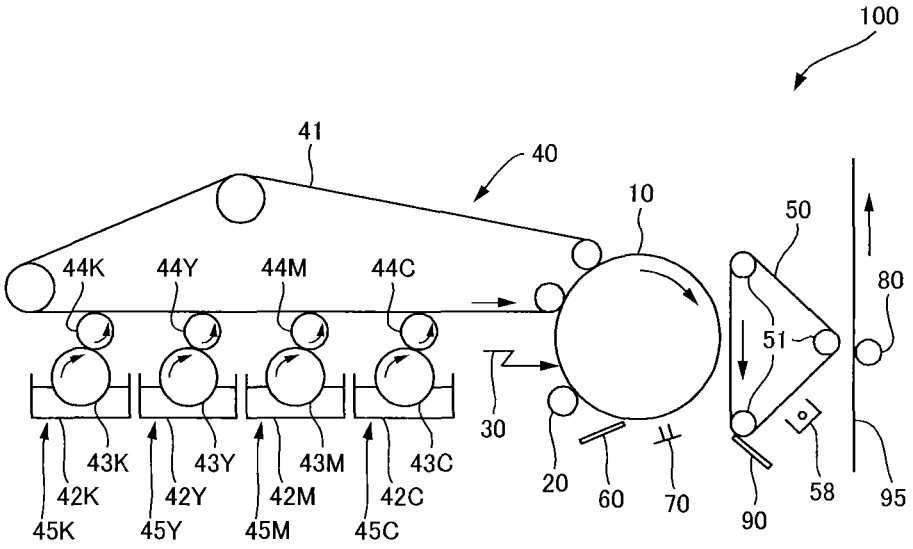
FIG. 2 is a schematic configurational diagram illustrating one example of an image forming apparatus of the present invention.

In the color image forming apparatus 100 illustrated in FIG. 2, the charging roller 20 uniformly charges a surface of the electrostatic latent image bearing member 10, and then the exposing device 30 imagewise-exposes the electrostatic latent image bearing member 10 to form an electrostatic latent image. Next, the electrostatic latent image formed on the electrostatic latent image bearing member 10 is developed with a toner supplied from the developing device 40 to form a toner image. Further, the toner image is transferred (primarily transferred) onto the intermediate transfer medium 50 by voltage applied from the roller 51 and then transferred (secondarily transferred) onto transfer paper 95. As a result, a transferred image is formed on the transfer paper 95. Notably, a residual toner remaining on the electrostatic latent image bearing member 10 is removed by the cleaning device 60, and the electrostatic latent image bearing member 10 is once charge-eliminated by the charge-eliminating lamp 70.

Figure 3:
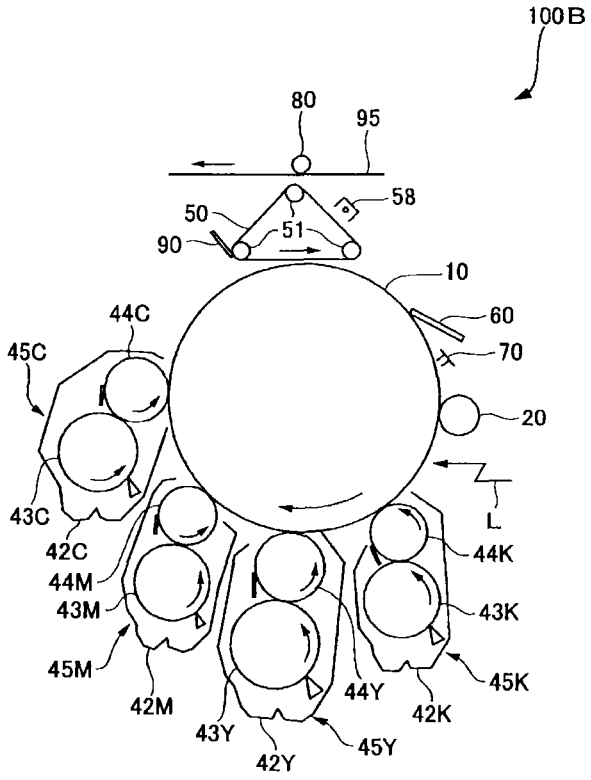
FIG. 3 is a schematic configurational diagram illustrating another example of an image forming apparatus of the present invention.

FIG. 3 illustrates another example of an image forming apparatus of the present invention. The image forming apparatus 100B has the same configuration as the image forming apparatus 100 illustrated in FIG. 2 except that the developing belt 41 is not included and that, around the photoconductor drum 10, the black developing unit 45K, the yellow developing unit 45Y, the magenta developing unit 45M and the cyan developing unit 45C are disposed facing directly to the electrostatic latent image bearing member.

Figure 4:
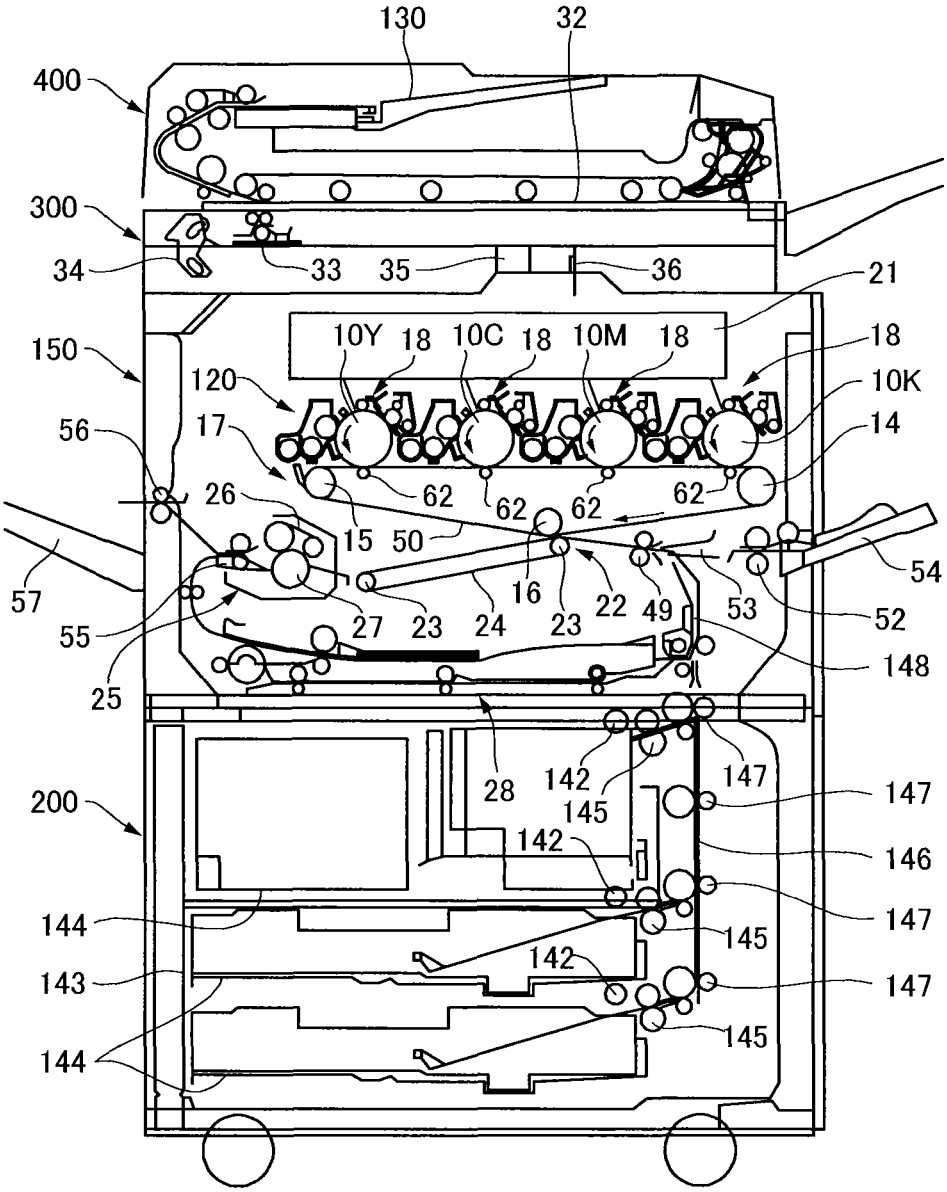
FIG. 4 is a schematic configurational diagram illustrating still another example of an image forming apparatus of the present invention.

The color image forming apparatus illustrated in FIG. 4 includes a copying device main body 150, a sheet feeding table 200, a scanner 300 and an automatic document feeder (ADF) 400.

An intermediate transfer medium 50 which is an endless belt is disposed at a central part of the copying device main body 150. The intermediate transfer medium 50 is stretched around support rollers 14, and 16 and can rotate in a clockwise direction in FIG. 4. Near the support roller 15, a cleaning device for the intermediate transfer medium 17 is disposed to remove a residual toner remaining on the intermediate transfer medium 50. On the intermediate transfer medium 50 stretched around the support rollers 14 and 15, a tandem type developing device 120 is disposed in which four image forming units 18 of yellow, cyan, magenta and black are arranged in parallel so as to face to each other along a conveying direction thereof. The exposing device 21 is disposed in proximity to the tandem type developing device 120. Further, a secondary transfer device 22 is disposed on a side of the intermediate transfer medium 50 opposite to the side on which the tandem type developing device 120 is disposed. In the secondary transfer device 22, the secondary transfer belt 24 which is an endless belt is stretched around a pair of rollers 23, and the transfer paper conveyed on the secondary transfer belt 24 and the intermediate transfer medium 50 may contact with each other. Here, a fixing device 25 is disposed in proximity to the secondary transfer device 22. The fixing device 25 includes a fixing belt 26 which is an endless belt and a pressure roller 27 which is disposed so as to be pressed against the fixing belt.

Here, in the tandem type image forming apparatus, a sheet inverting device 28 is disposed near the secondary transfer device 22 and the fixing device 25 for inverting the transfer paper in the case of forming images on both sides of the transfer paper.

Next, a method for forming a full-color image (color-copying) using the tandem type developing device 120 will be explained. First, a color document is set on a document table 130 of the automatic document feeder (ADF) 400. Alternatively, the automatic document feeder 400 is opened, the color document is set on a contact glass 32 of the scanner 300, and the automatic document feeder 400 is closed.

When a start button (not shown) is pressed, the scanner 300 activates after the color document is conveyed and moved to the contact glass 32 in the case the color document has been set on the automatic document feeder 400, or right away in the case the color document has been set on the contact glass 32, so that a first travelling body 33 and a second travelling body 34 travel. At this time, a light is irradiated from a light source in the first travelling body 33, the light reflected from a surface of the document is reflected by a mirror in the second travelling body 34 and then is received by a reading sensor 36 through an imaging lens 35. Thus, the color document (color image) is read to thereby form black, yellow, magenta and cyan image information.

Figure 5:
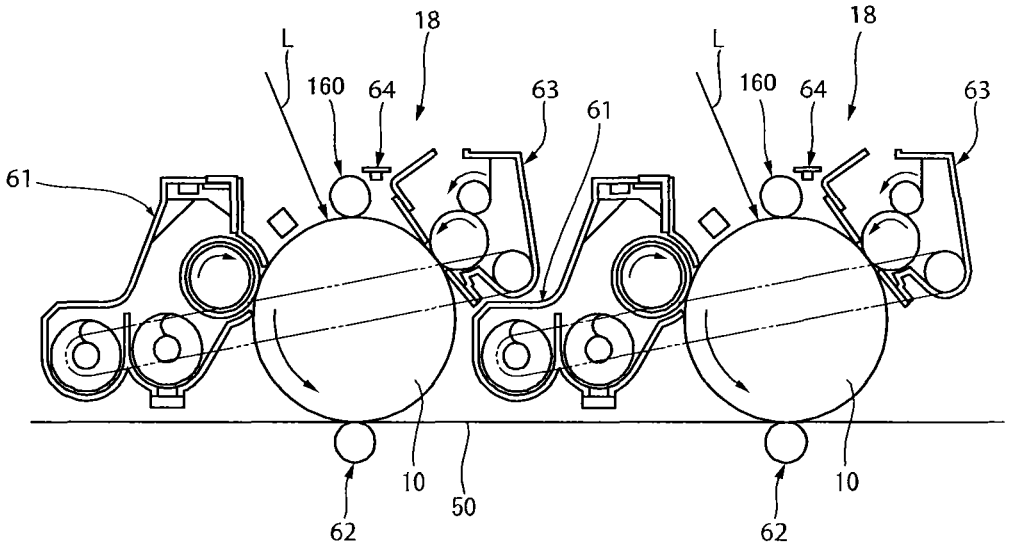
FIG. 5 is a partially enlarged diagram of FIG. 4.

The image informations of black, yellow, magenta, and cyan are transmitted to the image forming units 18 (black image forming unit, yellow image forming unit, magenta image forming unit, and cyan image forming unit) in the tandem type developing device 120, and toner images of black, yellow, magenta, and cyan are formed in the image forming units. As illustrated in FIG. 5, the image forming units 18 (black image forming unit, yellow image forming unit, magenta image forming unit, and cyan image forming unit) in the tandem type developing device 120 include: electrostatic latent image bearing members 10 (black electrostatic latent image bearing member 10K, yellow electrostatic latent image bearing member 10Y, magenta electrostatic latent image bearing member 10M, and cyan electrostatic latent image bearing member 10C); a charging device 160 configured to uniformly charge the electrostatic latent image bearing members 10; an exposing device configured to imagewise-expose to a light (L illustrated in FIG. 5) the electrostatic latent image bearing members based on color image informations to form an electrostatic latent image corresponding to color images on the electrostatic latent image bearing members; a developing device 61 configured to develop the electrostatic latent images with color toners (black color toner, yellow color toner, magenta color toner, and cyan color toner) to form a toner image of the color toners; a transfer charger 62 configured to transfer the toner image onto the intermediate transfer medium 50; a cleaning device 63; and a charge-eliminating unit 64; and can form monochrome images (black image, yellow image, magenta image, and cyan image) based on image formations of colors. Thus formed black image (i.e., black image formed onto the black electrostatic latent image bearing member 10K), yellow image (i.e., yellow image formed onto the yellow electrostatic latent image bearing member 10Y), magenta image (i.e., magenta image formed onto the magenta electrostatic latent image bearing member 10M), and cyan image (i.e., cyan image formed onto the cyan electrostatic latent image bearing member 10C) are sequentially transferred (primarily transferred) onto the intermediate transfer medium 50 which is rotatively moved by the support rollers 14, 15 and 16. The black image, the yellow image, the magenta image, and the cyan image are superposed on the intermediate transfer medium 50 to thereby form a composite color image (color transfer image).

Meanwhile, on the sheet feeding table 200, one of sheet feeding rollers 142 is selectively rotated to feed a sheet (recording paper) from one of the paper feed cassettes 144 equipped in multiple stages in a paper bank 143. The sheet (recording paper) is separated one by one by a separation roller 145 and sent to a sheet feeding path 146. The sheet (recording paper) is conveyed by a conveying roller 147 and is guided to a sheet feeding path 148 in the copying device main body 150, and stops by colliding with a resist roller 49. Alternatively, a sheet feeding roller 142 is rotated to feed a sheet (recording paper) on a manual feed tray 54. The sheet (recording paper) is separated one by one by a separation roller 52 and is guided to a manual sheet feeding path 53, and stops by colliding with the resist roller 49. Notably, the resist roller 49 is generally used while grounded, but it may also be used in a state that a bias is being applied for removing paper dust on the sheet. Next, by rotating the resist roller 49 in accordance with the timing of the composite toner image (color transferred image) formed on the intermediate transfer medium 50, the sheet (recording paper) is fed to between the intermediate transfer medium 50 and the secondary transfer device 22. Thereby, the composite toner image (color transferred image) is transferred (secondarily transferred) by the secondary transfer device 22 onto the sheet (recording paper) to thereby form a color image on the sheet (recording paper). Notably, a residual toner remaining on the intermediate transfer medium 50 after image transfer is removed by the cleaning device for the intermediate transfer medium 17.

The sheet (recording paper) on which the color image has been transferred is conveyed by the secondary transfer device 22, and then conveyer to the fixing device 25. In the fixing device 25, the composite color image (color transferred image) is fixed on the sheet (recording paper) by the action of heat and pressure. Next, the sheet (recording paper) is switched by a switching claw 55, and discharged by a discharge roller 56 and stacked in a paper discharge tray 57. Alternatively, the sheet (recording paper) is switched by the switching claw 55, and is inverted by the inverting device 28 to thereby be guided to a transfer position again. After an image is formed similarly on the rear surface, the recording paper is discharged by the discharge roller 56 stacked in the paper discharge tray 57.

EXAMPLES

Examples of the present invention now will be explained, but the scope of the present invention is not limited thereto. In the following Examples, "part(s)" means "part(s) by mass" and "%" means "% by mass", unless otherwise specified.

Production Example 1

<Production of Crystalline Resin A1 (Urethane-Modified Crystalline Polyester Resin A1)>

A reaction tank equipped with a condenser, a stirrer, and a nitrogen inlet tube was charged with 202 parts by mass (1.00 mol) of sebacic acid, 15 parts by mass (0.10 mol) of adipic acid, 177 parts by mass (1.50 mol) of 1,6-hexanediol, and as a condensation catalyst, 0.5 parts by mass of tetrabutoxy titanate, and the resulting mixture was allowed to react for 8 hours at 180° C. under nitrogen gas stream while produced water was removed by distillation. The mixture was then gradually heated to 220° C., and was allowed to react for 4 hours under nitrogen gas stream while produced water and 1,6-hexanediol were removed by distillation. The resultant was further allowed to react under a reduced pressure of 5 mmHg to 20 mmHg until the weight average molecular weight (Mw) thereof reached about 12,000 to thereby obtain [crystalline polyester resin A'1]. The resultant [crystalline polyester resin A'1] was found to have Mw of 12,000.

The total amount of the resultant [crystalline polyester resin A'1] was transferred to a reaction tank equipped with a condenser, a stirrer, and a nitrogen inlet tube. To this, 350 parts by mass of ethyl acetate, and 30 parts by mass (0.12 mol) of 4,4'-diphenyl methane diisocyanate (MDI) were added, and the resulting mixture was allowed to react for 5 hours at 80° C. under nitrogen gas stream. Subsequently, the ethyl acetate was removed by distillation under a reduced pressure, to thereby obtain [urethane-modified crystalline polyester resin A1]. The resultant [urethane-modified crystalline polyester resin A1] was found to have Mw of 25,000, and a melting point of 63° C.

Production Example 2

<Production of Crystalline Resin A2 (Crystalline Polyester Resin A2)>

A reaction tank equipped with a condenser, a stirrer, and a nitrogen inlet tube was charged with 353 parts by mass of 1,10-decanediol, 200 parts by mass of adipic acid, 89 parts by mass of 5-sulphoisophthalic acid, and 0.8 parts by mass of dibutyltin oxide, and the resulting mixture was allowed to react for 6 hours at 180° C. under a normal pressure, followed by for 4 hours under a reduced pressure of 10 mmHg to 15 mmHg to thereby synthesize [crystalline resin A2 (crystalline polyester resin A2)]. The resultant [crystalline resin A2 (crystalline polyester resin A2)] was found to have the number average molecular weight (Mn) of 14,000, the weight average molecular weight (Mw) of 33,000, and the melting point of 65° C. The endothermic amount showed the maximum at the melting point.

Production Example 3

<Production of Crystalline Resin B1 (Urethane-Modified Crystalline Polyester Resin B1)>

A reaction tank equipped with a condenser, a stirrer, and a nitrogen inlet tube was charged with 113 parts by mass (0.56 mol) of sebacic acid, 109 parts by mass (0.56 mol) of dimethyl terephthalate, 132 parts by mass (1.12 mol) of 1,6-hexanediol, and as a condensation catalyst, 0.5 parts by mass of titanium dihydroxybis(triethanolaminate), and the resulting mixture was allowed to react for 8 hours at 180° C. under nitrogen gas stream while produced water and methanol was removed by distillation. The mixture was then gradually heated to 220° C., and was allowed to react for 4 hours under nitrogen gas stream while produced water and 1,6-hexanediol were removed by distillation. The resultant was, further allowed to react under a reduced pressure of 5 mmHg to 20 mmHg until Mw thereof reached about 35,000 to thereby obtain [crystalline polyester resin B'1]. The resultant [crystalline polyester resin B'1] was found to have Mw of 34,000.

The total amount of the resultant [crystalline polyester resin B' 1] was transferred to a reaction tank equipped with a condenser, a stirrer, and a nitrogen inlet tube. To this, 200 parts by mass of ethyl acetate, and 10 parts by mass (0.06 mol) of hexamethylene diisocyanate (HDI) were added, and the resulting mixture was allowed to react for 5 hours at 80° C. under nitrogen gas stream. Subsequently, the ethyl acetate was removed by distillation under a reduced pressure, to thereby obtain [urethane-modified crystalline polyester resin B1]. The resultant [urethane-modified crystalline polyester resin B1] was found to have Mw of 63,000, and a melting point of 65° C.

Production Example 4

<Production of Crystalline Resin Precursor C1>

A reaction tank equipped with a condenser, a stirrer, and a nitrogen inlet tube was charged with 202 parts by mass (1.00 mol) of sebacic acid, 122 parts by mass (1.03 mol) of 1,6-hexanediol, and as a condensation catalyst, 0.5 parts by mass of titanium dihydroxybis(triethanolaminate), and the resulting mixture was allowed to react for 8 hours at 180° C. under nitrogen gas stream while produced water was removed by distillation. The mixture was then gradually heated to 220° C., and was allowed to react for 4 hours under nitrogen gas stream while produced water and 1,6-hexanediol were removed by distillation. The resultant was further allowed to react under a reduced pressure of 5 mmHg to 20 mmHg until the weight average molecular weight (Mw) thereof reached about 25,000 to thereby obtain [crystalline resin C'1].

The total amount of the resultant [crystalline resin C'1] was transferred to a reaction tank equipped with a condenser, a stirrer, and a nitrogen inlet tube. To this, 300 parts by mass of ethyl acetate, and 27 parts by mass (0.16 mol) of hexamethylene diisocyanate (HDI) were added, and the resulting mixture was allowed to react for 5 hours at 80° C. under nitrogen gas stream to thereby obtain a 50% by mass ethyl acetate solution of [crystalline resin precursor C1] having a terminal isocyanate group.

The resultant 50% ethyl acetate solution of [crystalline resin precursor C1] (10 parts by mass) was mixed with tetrahydrofuran (THF) (10 parts by mass). To this, was added dibutyl amine (1 part by mass), followed by stirring for 2 hours to thereby a sample solution. The resultant sample solution was subjected to GPC measurement and the [crystalline resin precursor C1] was found to have the weight average molecular weight of 53,000. The solution was desolvated and subjected to DSC measurement, and the [crystalline resin precursor C1] was found to have a melting point of 57° C. The endothermic amount showed the maximum at the melting point.

Production Example 5

<Production of Non-Crystalline Resin C1>

A reaction tank equipped with a condenser, a stirrer, and a nitrogen inlet tube was charged with 222 parts by mass of bisphenol A ethylene oxide 2 mol adduct, 129 parts by mass of bisphenol A propylene oxide 2 mol adduct, 166 parts by mass of isophthalic acid, and 0.5 parts by mass of tetrabutoxy titanate, and the resulting mixture was allowed to react for 8 hours at 230° C. and at normal pressure under nitrogen gas stream while produced water was removed by distillation. Subsequently, the reactant was allowed to react under a reduced pressure of 5 mmHg to 20 mmHg, followed by cooling to 180° C. at the time point when the acid value thereof reached 2 mgKOH/g. To this, 35 parts by mass of trimellitic anhydride was added, and the resulting mixture was allowed to react for 3 hours at normal pressure to thereby obtain [non-crystalline resin C1]. The resultant [non-crystalline resin C1] had found to have Mw of 8,000 and Tg of 62° C.

Example 1

<Synthesis of Releasing Agent Dispersing Agent 1>

An autoclave reaction tank to which a thermometer and a stirrer had been set was charged with 454 parts by mass of xylene and 150 parts by mass of a low molecular weight polyethylene (trade name: SANWAX LEL-400, product of Sanyo Chemical Industries, Ltd., softening point: 128° C.). After the autoclave reaction tank had been purged with nitrogen, the tank was heated to 170° C. to thereby thoroughly dissolve the content thereof. A mixed solution of styrene (595 parts by mass), methyl methacrylate (255 parts by mass), di-t-butylperoxyhexahydro terephthalate (34 parts by mass) and xylene (119 parts by mass) was added dropwise thereto at 170° C. for 3 hours to thereby allow to polymerize. The resultant polymer was kept at the same temperature for further 30 min. Next, the resultant polymer was desolvated to obtain [releasing agent dispersing agent 1]. The resultant [releasing agent dispersing agent 1] was found to have the number average molecular weight (Mn) of 1,872, the weight average molecular weight (Mw) of 5,194 and Tg of 56.9° C.

<Preparation of Releasing Agent Dispersion Liquid>

A vessel to which a stirring rod and a thermometer had been set was charged with 50 parts by mass of paraffin wax (HNP-9, product of NIPPON SEIRO CO., LTD., hydrocarbon wax, melting point: 75° C., SP value: 8.8), 30 parts by mass of the [releasing agent dispersing agent 1] and 420 parts by mass of ethyl acetate, and the resultant mixture was heated to 80° C. under stirring, kept at 80° C. for 5 hours and cooled to 30° C. for 1 hour. The resultant mixture was dispersed using a beads mill (ULTRAVISCOMILL, product of Aimex CO., LTD.) under the following conditions: liquid feed rate of 1 kg/hr, disc circumferential velocity of 6 m/s, 0.5 mm-zirconia beads packed to 80% by volume, and 3 passes, to thereby obtain [releasing agent dispersion liquid].

<Preparation of Masterbatch>

| [Raw materials] | |
|---|---|
| Urethane-modified crystalline polyester resin A1 | 100 parts by mass |
| Carbon black (PRINTEX 35, product of Degussa AG) (DBP absorption amount: 42 mL/100 g, pH: 9.5) | 100 parts by mass |
| Ion exchanged water | 50 parts by mass |

The above-listed materials were mixed together using HENSCHEL MIXER (product of NIPPON COKE & ENGINEERING CO., LTD.). The resultant mixture was kneaded using a two-roll. The kneading was initiated at a temperature of 90° C. and then the kneading temperature was gradually decreased to 50° C. The obtained kneaded product was pulverized with a pulverizer (product of Hosokawa Micron CO., LTD.) to prepare [masterbatch].

<Preparation of Oil Phase>

A vessel equipped with a thermometer and a stirrer was charged with 31.5 parts by mass of the [urethane-modified crystalline polyester resin A1] and ethyl acetate in such an amount that the solid content concentration would be 50% by mass, and the resultant mixture was heated to a temperature equal to or higher than the melting point of the resin so as to be thoroughly dissolved. To the resultant solution, were added 100 parts by mass of the 50% by mass ethyl acetate solution of the [non-crystalline resin C1], 60 parts by mass of the [releasing agent dispersion liquid], 12 parts by mass of the [masterbatch] and 0.100 parts by mass of [saturated alcohol 1] listed in Table 1. The resultant mixture was stirred at 50° C. using a TK HOMOMIXER (product of Tokushu Kika Kogyo Co., Ltd.) at 5,000 rpm, so that the components were homogeneously dissolved or dispersed to thereby obtain [oil phase]. Notably, the [oil phase] was kept at 50° C. in the vessel, and used within 5 hours after production so as not to be crystallized.

<Production of Aqueous Dispersion Liquid of Resin Particles>

A reaction vessel to which a stirring rod and a thermometer had been set was charged with 600 parts by mass of water, 120 parts by mass of styrene, 100 parts by mass of methacrylic acid, 45 parts by mass of butyl acrylate, 10 parts by mass of sodium alkylallyl sulfosuccinate (ELEMINOL JS-2, product of Sanyo Chemical Industries Ltd.) and 1 part by mass of ammonium persulfate, and the resultant mixture was stirred at 400 rpm for 20 min to obtain a white emulsion. The resultant white emulsion was heated to 75° C. in the system and allowed to react for 6 hours. To this, was added 30 parts by mass of a 1% by mass aqueous solution of ammonium persulfate. The resultant was then aged at 75° C. for 6 hours, to thereby obtain [aqueous dispersion liquid of resin particles]. The particles contained in the [aqueous dispersion liquid of resin particles] were found to have a volume average particle diameter of 80 nm, and the resin component thereof was found to have a weight average molecular weight of 160,000 and Tg of 74° C.

<Preparation of Aqueous Phase>

Water (990 parts by mass), the [aqueous dispersion liquid of resin particles] (83 parts by mass), a 48.5% by mass aqueous solution of sodium dodecyl diphenyl ether disulfonate (ELEMINOL MON-7, product of Sanyo Chemical Industries Ltd.) (37 parts by mass) and ethyl acetate (90 parts by mass) were mixed together to obtain [aqueous phase].

<Production of Toner Base Particles>

The [aqueous phase] (520 parts by mass) was added to another vessel to which a stirrer and a thermometer had been set, and then heated to 40° C.

To 235 parts by mass of [oil phase] which had been kept at 50° C., was added 25 parts by mass of 50% ethyl acetate solution of [crystalline resin precursor C1], and the resulting mixture was stirred by means of TK HOMOMIXER (product of Tokushu Kika Kogyo Co., Ltd.) at 5,000 rpm, followed by uniformly dissolving and dispersing to thereby obtain [oil phase (1)].

While the [aqueous phase] which had been kept at 40° C. to 50° C. was being stirred at 13,000 rpm using TK HOMOMIXER (product of Tokushu Kika Kogyo Co., Ltd.), the [oil phase (1)] was added thereto, followed by emulsification for 1 min, to thereby obtain [emulsified slurry 1].

Next, the obtained [emulsified slurry 1] was added to a vessel to which a stirrer and a thermometer had been set, followed by being desolvated at 60° C. for 6 hours to thereby obtain [slurry 1]. The obtained [slurry 1] was filtrated under reduced pressure and subjected to the following washing treatments.

(1) Ion exchanged water (100 parts by mass) was added to the filtration cake, followed by mixing with TK HOMOMIXER (at 6,000 rpm for 5 min) and filtrating.
(2) A 10% by mass aqueous sodium hydroxide solution (100 parts by mass) was added to the filtration cake obtained in (1), followed by mixing with TK HOMOMIXER (at 6,000 rpm for 10 min) and filtrating under reduced pressure.
(3) 10% by mass hydrochloric acid (100 parts by mass) was added to the filtration cake obtained in (2), followed by mixing with TK HOMOMIXER (at 6,000 rpm for 5 min) and filtrating.
(4) Ion-exchanged water (300 parts by mass) was added to the filtration cake obtained in (3), followed by mixing with TK HOMOMIXER (at 6,000 rpm for 5 min) and filtrating. This treatment was performed twice to thereby obtain filtration cake (1).

The obtained filtration cake (1) was dried with an air-circulation dryer at 45° C. for 48 hours, and then sieved with a mesh having an opening size of 75 μm to obtain [toner base particles].

Then, the obtained [toner base particles] (100 parts by mass) was mixed with 1.0 part by mass of hydrophobic silica (HDK-2000, product of Wacker Chemie AG) using HENSCHEL MIXER to thereby produce [toner] having a volume average particle diameter of 5.8 μm.

<Production of Developer>

—Production of Carrier—

A carrier used in a two-component developer was produced in the following manner.

As for a core material, 5,000 parts by mass of Mn ferrite particles (weight average particle diameter: 35 μm) were used. As for a coating material, a coating liquid was used which had been prepared by dispersing 450 parts by mass of toluene, 450 parts by mass of a silicone resin SR2400 (product of Dow Corning Toray Co., Ltd., nonvolatile content: 50% by mass), 10 parts by mass of aminosilane SH6020 (product of Dow Corning Toray Co., Ltd.) and 10 parts by mass of carbon black for 10 min with a stirrer. The coating device was charged with the core material and the coating liquid to thereby coat the core material with the coating liquid. The coating device was equipped with a rotatable bottom plate disk and a stirring blade, and performed coating by forming swirling air flow in a flow bed. The resulting coated product was baked in an electric furnace for 2 hours at 250° C., to thereby obtain [carrier A].

—Production of Two-Component Developer—

The resultant [toner] (7 parts by mass) was uniformly mixed with [carrier A] (100 parts by mass) by means of TURBULA MIXER (product of Willy A. Bachofen (WAB) AG), in which a vessel was driven in rolling motions to perform stirring, for 3 min at 48 rpm to thereby charge the toner. In the present invention, a stainless steel vessel having an internal volume of 500 mL was charged with 200 g of the [carrier A] and 14 g of the [toner] and mixed.

The thus obtained two-component developer was loaded in a developing unit of a tandem type image forming apparatus using an intermediate transfer system (image forming apparatus illustrated in FIG. 4) employing a contact charging system, two-component developing system, secondary transferring system, blade cleaning system, and external heating roller fixing system to perform image formation. In the image formation, performance of the toner and developer was evaluated. Results are shown in Tables 2-1 to 2-3.

<Evaluation>

<<Amount of Compound Represented by General Formula (1)>>

An amount of the compound represented by General Formula (1) contained in the toner was measured using a liquid chromatography (AQULITY UPLC Binary Solvent Maneager, product of Nihon Waters K.K.). Firstly, about 0.2 g of the toner was weighed and dispersed into 20 mL of methanol, followed by subjecting to ultrasonication for 30 min. The resultant was further stirred at 300 rpm for 48 hours at 60° C. The supernatant thereof filtered through a membrane filter having an aperture size of 0.45 μm. Thus obtained sample was diluted to 100 times by methanol, followed by measuring.

<<Storage Elastic Modulus (G') of Toner>>

The storage elastic modulus at 70° C. [G' (70)] and the storage elastic modulus at 160° C. [G' (160)] of the toner were measured as follows.

The measurement was performed using a dynamic viscoelasticity measuring apparatus (ARES, product of TA Instruments, Inc.). Firstly, a sample was formed into pellets having a diameter of 8 mm and a thickness of 1 mm to 2 mm, fixed on a parallel plate having a diameter of 8 mm, which was then stabilized at 40° C., and heated to 200° C. at a heating rate of 2.0° C./min with a frequency of 1 Hz (6.28 rad/s) and a strain amount of 0.1% (strain amount control mode), and a measurement was taken.

<<Tsh 2nd/Tsh 1st>>

A ratio (Tsh 2nd/Tsh 1st) of a shoulder temperature of a peak of heat of fusion in a first heating (Tsh 1st) and a shoulder temperature of a peak of heat of fusion in a second heating (Tsh 2nd) in a measurement of the toner by a differential scanning calorimetry (DSC) was measured as follows.

The measurement was performed using a differential scanning calorimeter (TA-60WS and DSC-60, product of Shimadzu Corporation). At first, 5.0 mg of the toner was placed in in an aluminum container, and the container was placed on a holder unit and set in an electric furnace.

Next, in a nitrogen atmosphere, it was heated from 0° C. to 150° C. at a heating rate of 10° C./min, cooled from 150° C. to 0° C. at a cooling rate of 10° C./min and then heated to 150° C. at a heating rate of 10° C./min, during which a DSC curve was measured. In the DSC curve, an endothermic peak temperature in the first heating was determined as Tm 1st and an endothermic peak temperature in the second heating was determined as Tm 2nd. In a case in which multiple endothermic peaks were observed in each DSC curve, a peak having the maximum endothermic amount was selected. An intersection of the lower-temperature-side baseline with the tangent line of the lower-temperature-side slope of each selected endothermic peak was determined. The temperatures at the intersections in the first and second DSC curves were determined as Tsh 1st and Tsh 2nd, respectively.

<<Average Circularity>>

The average circularity of the toner was measured as follows.

The average circularity of the toner was measured by a flow-type particle image analyzer (FPIA-2100, product of SYSMEX CORPORATION), and the obtained data were analyzed using analysis software (FPIA-2100 DATA PROCESSING PROGRAM FOR FPIA Version 00-10). Specifically, a 10% by mass surfactant (alkylbenzene sulfonate, NEOGEN SC-A, product of Daiichi Kogyo Seiyaku Co.) (0.1 mL to 0.5 mL) was added to a 100 mL-glass beaker, and a toner (0.1 g to 0.5 g) was added thereto, followed by stirring with a microspartel. Subsequently, ion-exchanged water (80 mL) was added to the beaker, and the obtained dispersion liquid is dispersed with an ultrasonic wave disperser (product of Honda Electronics Co.) for 3 min. Using the FPIA-2100, the shape and distribution of toner particles were measured until the concentration of the dispersion liquid was in the range of 5,000 particles per microliter to 15,000 particles per microliter.

<<Volume Average Particle Diameter>>

The volume average particle diameter of the toner was measured as follows.

The volume average particle diameter of the toner was measured using a particle size analyzer ("MULTISIZER III," product of Beckman Coulter Co.) with the aperture diameter being set to 100 μm, and the obtained measurements were analyzed with an analysis software (Beckman Coulter Multisizer 3 Version 3.51). Specifically, a 10% by mass surfactant (alkylbenzene sulfonate, NEOGEN SC-A, product of Daiichi Kogyo Seiyaku Co.) (0.5 mL) was added to a 100 mL-glass beaker, and a toner (0.5 g) is added thereto, followed by stirring with a microspartel. Subsequently, ion-exchanged water (80 mL) was added to the beaker, and the obtained dispersion liquid is dispersed with an ultrasonic wave disperser (W-113MK-II, product of Honda Electronics Co.) for 10 min. The resultant dispersion liquid was measured using the above particle size analyzer MULTISIZER III and ISOTON III (product of Beckman Coulter Co.) serving as a solution for measurement. The dispersion liquid containing the toner sample was added dropwise so that the concentration indicated by the analyzer falls within a range of 8% by mass ±2% by mass.

<Amount of Crystalline Structure [C/(A+C)]>

The amount of crystalline structure [C/(A+C)] was measured by an X-ray diffraction measurement as follows.

A toner was used as a measurement sample.

The X-ray diffraction measurement was performed using an X-ray diffractometer equipped with a 2-dimensional detector (D8 DISCOVER with GADDS, product of Bruker Corporation).

As a capillary for the measurement, a mark tube (Lindemann glass) having a diameter of 0.70 mm was used. This capillary tube for the measurement was filled up with a sample (toner) with being tapped. The number of tapping was 100. Measurement conditions are described in detail below.

Tube current: 40 mA
Tube voltage: 40 kV
Goniometer 2θ axis: 20.0000°
Goniometer Ω axis: 0.0000°:
Goniometer ϕ axis: 0.0000°:
Detector distance: 15 cm (wide angle measurement)
Measuring range: 3.2≤2θ(°)≤37.2
Measurement time: 600 sec A collimator having a pinhole with a diameter of 1 mm was used for an incident optical system. Obtained 2-dimensional data was integrated with a supplied software (at 3.2° to 37.2° in the x-axis) and converted to a 1-dimensional data of a diffraction intensity and 2θ.

A method for calculating the ratio [C/(A+C)] based on the obtained X-ray diffraction measurement results will be explained below. An example of a diffraction spectrum obtained by an X-ray diffraction measurement is illustrated in FIG. 1A and FIG. 1B. The horizontal axis represents 2θ, the vertical axis represents the X-ray diffraction intensity, and both of them are linear axes. In the X-ray diffraction spectrum illustrated in FIG. 1A, there are main peaks at 2θ=21.3° (P1) and 24.2° (P2), halos (h) are observed in a wide range including these two peaks. Here, the main peaks are derived from a crystalline structure of a binder resin, and the halos are derived from a non-crystalline structure.

These two main peaks and halos were expressed by a Gaussian functions:

$$f_{p1}(2\theta)=a_{p1}\exp\{-(2\theta-b_{p1})^2/(2c_{p1}^2)\} \quad \text{Equation A(1)}$$

$$f_{p2}(2\theta)=a_{p2}\exp\{-(2\theta-b_{p2})^2/(2c_{p2}^2)\} \quad \text{Equation A(2)}$$

$$f_h(2\theta)=a_h\exp\{-(2\theta-b_h)^2/(2c_h^2)\} \quad \text{Equation A(3)}$$

where $f_{p1}(2\theta)$, $f_{p2}(2\theta)$, and $f_h(2\theta)$ denote functions corresponding to the main peak P1, the main peak P2 and halos, respectively.

A sum of these functions:

$$f(2\theta)=f_{p1}(2\theta)+f_{p2}(2\theta)+f_h(2\theta) \quad \text{Equation A(4)}$$

was regarded as a fitting function of the overall X-ray diffraction spectrum (illustrated in FIG. 1B), which was fitted with a least square method.

There were 9 fitting variables: $a_{p1}$, $b_{p1}$, $c_{p1}$, $a_{p2}$, $b_{p2}$, $c_{p2}$, $a_h$, $b_h$ and $c_h$. As initial values of these fitting variable, peak positions of the X-ray diffraction were set for $b_{p1}$, $b_{p2}$ and $b_h$ (in the example of FIG. 1A, $b_{p1}$=21.3, $b_{p2}$=24.2, and $b_h$=22.5), and appropriate values were input for the other variables so that the two main peaks and halos coincide as much as possible with the X-ray diffraction spectrum. The fitting was carried out using SOLVER of Excel 2003 (product of Microsoft Corporation).

From the integrated areas ($S_{p1}$, $S_{p2}$, $S_h$) of the Gaussian functions $f_{p1}(2\theta)$, $f_{p2}(2\theta)$ corresponding to the two main peaks (P1, P2) and Gaussian function $f_h(2\theta)$ corresponding to the halos after fitting, the ratio [C/(A+C)] as an index indicating the amount of the crystallization site was calculated, assuming ($S_{p1}$+$S_{p2}$) was (C) and ($S_h$) was (A).

<<Volume Resistivity>>

The volume resistivity was measured as follows.

A measurement sample was produced by molding 3 g of the toner into pellets having a diameter of 40 mm and a thickness of 2 mm using an automatic pellet molding device (Type M No. 50 BRP-E; product of MAEKAWA TESTING MACHINE CO.) under the following conditions: a load: 6 t and pressing time: 1 min. The sample was set in SE-70 solid-state electrodes (product of Ando Electric Co., Ltd.), and logR when an alternating current of 1 kHz was applied between the electrodes was measured using a measurement device composed of TR-10C dielectric loss measuring instrument, WBG-9 oscillator and BDA-9 equilibrium point detector (these products are of Ando Electric Co., Ltd.), and thereby the volume resistivity LogR of the toner was determined. The RATIO was $1\times10^{-9}$. The measurement was performed under an environment of 25° C. (room temperature) and 50% RH.

<<Low-Temperature Fixing Property (Fixing Lower Limit Temperature)>>

Using the image forming apparatus illustrated in FIG. 4, a solid image having an image size of 3 cm×8 cm and a toner deposition amount of 0.85 mg/cm$^2$±0.10 mg/cm$^2$ was formed on a paper sheet (product of Ricoh Business Expert, Ltd., a copy paper sheet <70>). Then, the formed solid image was fixed with varying temperature of the fixing belt. The fixed image surface was drawn with a ruby needle (tip radius: 260 μmR to 320 μmR, tip angle: 60 degrees) at a load of 50 g using a draw tester AD-401 (product of Ueshima Seisakusho Co., Ltd.). The drawn image surface was strongly rubbed five times with a fabric (HONECOTTO #440, product of Hanylon Co., Ltd.). Here, the temperature of the fixing belt at which almost no peeling-off of the image occurred was determined as the fixing lower limit temperature. The solid image was formed on the transfer paper at a position 3.0 cm away from a leading end of the transfer paper in a paper feeding direction. Notably, the speed at which the transfer paper passed through the nip portion of the fixing device was 280 mm/s. The lower fixing lower limit temperature means the more excellent low-temperature fixing property.

<<Transferability>>

The device was driven to develop an entire area with black, and stopped in the middle of the transferring procedure. The toner present on the untransfer portion and transfer portion of the photoconductor was taken by an adhesive paper having a given mass and a constant area, and weighed. The transfer rate was calculated from the following expression: [(mass of toner in untransfer portion−mass of toner in transfer portion)/mass of toner in untransfer portion]×100. Thus obtained transfer rate of the toner was evaluated according to the following criteria.

[Evaluation Criteria]

A: 95%≤Transferability

B: 90%≤Transferability<95%

C: 80%≤Transferability<90%

D: Transferability<80%

<<Heat-Resistant Storage Stability>>

A toner was charged into a 50-mL glass container and left to stand in a thermostat bath of 50° C. for 24 hours. The thus-treated toner was cooled to 24° C. and then measured for penetration degree (mm) by the penetration degree test (JIS K2235-1991) and evaluated according to the following evaluation criteria. Notably, the greater penetration degree means the more excellent heat resistance storage stability. Toner having a penetration degree of less than 15 mm is highly likely to cause problems in use.

[Evaluation Criteria]

A: 25 mm≤Penetration degree

B: 20 mm≤Penetration degree<25 mm

C: 15 mm≤Penetration degree<20 mm

D: Penetration degree<15 mm

Example 2

The toner and the developer were produced in the same manner as in Example 1, except that the amount of the [saturated alcohol 1] was changed from 0.100 parts by mass to 0.020 parts by mass at the "Preparation of Oil Phase" in Example 1. The resultant toner and developer were evaluated for their performance. Results are shown in Tables 2-1 to 2-3.

Example 3

The toner and the developer were produced in the same manner as in Example 1, except that the amount of the [saturated alcohol 1] was changed from 0.100 parts by mass to 0.050 parts by mass at the "Preparation of Oil Phase" in Example 1. The resultant toner and developer were evaluated for their performance. Results are shown in Tables 2-1 to 2-3.

Example 4

The toner and the developer were produced in the same manner as in Example 1, except that 0.100 parts by mass of the [saturated alcohol 1] was changed to 0.080 parts by mass of the [saturated alcohol 2] described in Table 1 at the "Preparation of Oil Phase" in Example 1. The resultant toner and developer were evaluated for their performance. Results are shown in Tables 2-1 to 2-3.

Example 5

The toner and the developer were produced in the same manner as in Example 1, except that the [saturated alcohol 1] was changed to the [saturated alcohol 3] described in Table 1 at the "Preparation of Oil Phase" in Example 1. The resultant toner and developer were evaluated for their performance. Results are shown in Tables 2-1 to 2-3.

Example 6

The toner and the developer were produced in the same manner as in Example 1, except that the [saturated alcohol 1] was changed to the [saturated alcohol 4] described in Table 1 at the "Preparation of Oil Phase" in Example 1. The resultant toner and developer were evaluated for their performance. Results are shown in Tables 2-1 to 2-3.

Example 7

The toner and the developer were produced in the same manner as in Example 1, except that the amount of the [urethane-modified crystalline polyester resin A1] was changed from 31.5 parts by mass to 81.5 parts by mass and the amount of the 50% ethyl acetate solution of [non-crystalline resin C1] was changed from 100 parts by mass to 0 parts by mass at the "Preparation of Oil Phase" in Example 1. The resultant toner and developer were evaluated for their performance. Results are shown in Tables 2-1 to 2-3.

Example 8

The toner and the developer were produced in the same manner as in Example 1, except that 31.5 parts by mass of the [urethane-modified crystalline polyester resin A1] was changed to 21.5 parts by mass of the [urethane-modified crystalline polyester resin A1] and 10 parts by mass of the [crystalline resin A2] at the "Preparation of Oil Phase" in Example 1. The resultant toner and developer were evaluated for their performance. Results are shown in Tables 2-1 to 2-3.

Example 9

The toner and the developer were produced in the same manner as in Example 1, except that the amount of the [urethane-modified crystalline polyester resin A1] was changed from 31.5 parts by mass to 21.5 parts by mass and the amount of the 50% ethyl acetate solution of [non-crystalline resin C1] was changed from 100 parts by mass to 120 parts by mass at the "Preparation of Oil Phase" in Example 1. The resultant toner and developer were evaluated for their performance. Results are shown in Tables 2-1 to 2-3.

Example 10

The toner and the developer were produced in the same manner as in Example 1, except that the [saturated alcohol 1] was changed to the [saturated carboxylic acid 1] described in Table 1 at the "Preparation of Oil Phase" in Example 1. The resultant toner and developer were evaluated for their performance. Results are shown in Tables 2-1 to 2-3.

Example 11

The toner and the developer were produced in the same manner as in Example 1, except that the [saturated alcohol 1] was changed to the [saturated amine 1] described in Table 1 at the "Preparation of Oil Phase" in Example 1. The resultant toner and developer were evaluated for their performance. Results are shown in Tables 2-1 to 2-3.

Example 12

The toner and the developer were produced in the same manner as in Example 1, except that the [saturated alcohol 1] was changed to the [saturated carboxylic acid 2] described in Table 1 at the "Preparation of Oil Phase" in Example 1. The resultant toner and developer were evaluated for their performance. Results are shown in Tables 2-1 to 2-3.

Example 13

The toner and the developer were produced in the same manner as in Example 1, except that the [urethane-modified crystalline polyester resin A1] was changed to the [urethane-modified crystalline polyester resin B1] at the "Preparation of Masterbatch" in Example 1; and 31.5 parts by mass of the [urethane-modified crystalline polyester resin A1] was changed to 81.5 parts by mass of the [urethane-modified crystalline polyester resin B1], and the amount of the 50% ethyl acetate solution of [non-crystalline resin C1] was changed from 100 parts by mass to 0 parts by mass at the "Preparation of Oil Phase" in Example 1. The resultant toner and developer were evaluated for their performance. Results are shown in Tables 2-1 to 2-3.

Example 14

The toner and the developer were produced in the same manner as in Example 1, except that 35 parts by mass of the [urethane-modified crystalline polyester resin A1] was changed to 44 parts by mass of the [urethane-modified crystalline polyester resin B1], and the amount of the 50% ethyl acetate solution of [crystalline resin precursor C1] was changed from 25 parts by mass to 0 parts by mass at the "Preparation of Oil Phase" in Example 1. The resultant toner and developer were evaluated for their performance. Results are shown in Tables 2-1 to 2-3.

Example 15

The toner and the developer were produced in the same manner as in Example 1, except that the amount of the [saturated alcohol 1] was changed from 0.100 parts by mass to 0.200 parts by mass at the "Preparation of Oil Phase" in Example 1. The resultant toner and developer were evaluated for their performance. Results are shown in Tables 2-1 to 2-3.

Comparative Example 1

The toner and the developer were produced in the same manner as in Example 1, except that the amount of the [saturated alcohol 1] was changed from 0.100 parts by mass to 0.300 parts by mass at the "Preparation of Oil Phase" in Example 1. The resultant toner and developer were evaluated for their performance. Results are shown in Tables 2-1 to 2-3.

Comparative Example 2

The toner and the developer were produced in the same manner as in Example 1, except that the amount of the [saturated alcohol 1] was changed from 0.100 parts by mass to 0 parts by mass at the "Preparation of Oil Phase" in Example 1. The resultant toner and developer were evaluated for their performance. Results are shown in Tables 2-1 to 2-3.

Comparative Example 3

The toner and the developer were produced in the same manner as in Example 1, except that the [saturated alcohol 1] was changed to the [saturated alcohol 5] described in Table 1 at the "Preparation of Oil Phase" in Example 1. The resultant toner and developer were evaluated for their performance. Results are shown in Tables 2-1 to 2-3.

Comparative Example 4

The toner and the developer were produced in the same manner as in Example 1, except that the [saturated alcohol 1] was changed to the [saturated alcohol 6] described in Table 1 at the "Preparation of Oil Phase" in Example 1. The resultant toner and developer were evaluated for their performance. Results are shown in Tables 2-1 to 2-3.

Comparative Example 5

The toner and the developer were produced in the same manner as in Example 1, except that the amount of the [saturated alcohol 1] was changed from 0.100 parts by mass to 0.005 parts by mass at the "Preparation of Oil Phase" in Example 1. The resultant toner and developer were evaluated for their performance. Results are shown in Tables 2-1 to 2-3.

Comparative Example 6

The toner and the developer were produced in the same manner as in Example 1, except that the [urethane-modified crystalline polyester resin A1] was changed to the [non-crystalline resin C1] at the "Preparation of Masterbatch" in Example 1; and 31.5 parts by mass of the [urethane-modified crystalline polyester resin A1] was changed to 44 parts by mass of the [non-crystalline resin C1] and the amount of the 50% ethyl acetate solution of [crystalline resin precursor C1] was changed from 25 parts by mass to 0 parts by mass at the "Preparation of Oil Phase" in Example 1. The resultant toner and developer were evaluated for their performance. Results are shown in Tables 2-1 to 2-3.

TABLE 1

| | Structure |
|---|---|
| Saturated alcohol 1 | $C_{12}H_{25}OH$ |
| Saturated alcohol 2 | $C_8H_{17}OH$ |
| Saturated alcohol 3 | $C_{18}H_{37}OH$ |
| Saturated alcohol 4 | $C_{22}H_{45}OH$ |
| Saturated alcohol 5 | $C_6H_{13}OH$ |
| Saturated alcohol 6 | $C_{30}H_{61}OH$ |
| Saturated carboxylic acid 1 | $C_{11}H_{23}COOH$ |
| Saturated amine 1 | $C_{12}H_{25}NH_2$ |
| Saturated carboxylic acid 2 | $C_{17}H_{35}COOH$ |

All alkyl chains in compounds described in Table 1 are linear alkyl chains.

TABLE 2-1

| | | Added compound | | | Molecular weight of Toner | |
|---|---|---|---|---|---|---|
| | | | Added amount (parts by mass) | Contained amount (% by mass) | Mw | 100,000 or more (%) |
| Example | 1 | Saturated alcohol 1 | 0.100 | 0.080 | 52,000 | 10.2 |
| | 2 | Saturated alcohol 1 | 0.020 | 0.015 | 50,000 | 10.9 |
| | 3 | Saturated alcohol 1 | 0.050 | 0.045 | 51,000 | 9.5 |
| | 4 | Saturated alcohol 2 | 0.080 | 0.075 | 49,000 | 9.3 |
| | 5 | Saturated alcohol 3 | 0.100 | 0.082 | 50,000 | 9.1 |
| | 6 | Saturated alcohol 4 | 0.100 | 0.088 | 50,000 | 10.0 |
| | 7 | Saturated alcohol 1 | 0.100 | 0.081 | 51,000 | 9.0 |
| | 8 | Saturated alcohol 1 | 0.100 | 0.085 | 51,000 | 9.5 |
| | 9 | Saturated alcohol 1 | 0.100 | 0.079 | 53,000 | 9.3 |
| | 10 | Saturated carboxylic acid 1 | 0.100 | 0.080 | 49,000 | 9.4 |
| | 11 | Saturated amine 1 | 0.100 | 0.084 | 49,000 | 9.1 |
| | 12 | Saturated carboxylic acid 2 | 0.100 | 0.085 | 50,000 | 9.5 |
| | 13 | Saturated alcohol 1 | 0.100 | 0.085 | 55,000 | 11.2 |
| | 14 | Saturated alcohol 1 | 0.100 | 0.080 | 47,000 | 3.4 |
| | 15 | Saturated alcohol 1 | 0.200 | 0.180 | 50,000 | 9.8 |
| Comparative Example | 1 | Saturated alcohol 1 | 0.300 | 0.270 | 49,000 | 9.1 |
| | 2 | — | — | — | 50,000 | 10.0 |
| | 3 | Saturated alcohol 5 | 0.100 | 0.086 | 50,000 | 9.0 |
| | 4 | Saturated alcohol 6 | 0.100 | 0.088 | 51,000 | 9.5 |
| | 5 | Saturated alcohol 1 | 0.005 | 0.002 | 51,000 | 9.3 |
| | 6 | Saturated alcohol 1 | 0.300 | 0.270 | 9,500 | 0.4 |

TABLE 2-2

| | | G' (70° C.) of Toner | G' (160° C.) of Toner | Tsh 2nd/ Tsh 1st | ΔH(H)/ ΔH(T) |
|---|---|---|---|---|---|
| Example | 1 | 230,000 | 3,000 | 0.99 | 0.76 |
| | 2 | 240,000 | 3,100 | 1.00 | 0.76 |
| | 3 | 260,000 | 3,200 | 0.99 | 0.75 |
| | 4 | 260,000 | 3,300 | 0.96 | 0.77 |
| | 5 | 260,000 | 3,200 | 1.00 | 0.77 |
| | 6 | 250,000 | 3,300 | 1.00 | 0.78 |
| | 7 | 230,000 | 3,000 | 0.99 | 0.76 |
| | 8 | 230,000 | 3,300 | 0.95 | 0.74 |
| | 9 | 260,000 | 3,500 | 0.90 | 0.64 |
| | 10 | 230,000 | 2,900 | 1.00 | 0.77 |
| | 11 | 230,000 | 3,000 | 0.99 | 0.76 |
| | 12 | 250,000 | 3,200 | 0.99 | 0.75 |
| | 13 | 500,000 | 3,000 | 0.99 | 0.78 |
| | 14 | 220,000 | 2,800 | 0.90 | 1.25 |
| | 15 | 230,000 | 3,000 | 0.98 | 0.78 |
| Comparative Example | 1 | 260,000 | 3,000 | 0.96 | 0.64 |
| | 2 | 260,000 | 3,200 | 1.10 | 0.77 |
| | 3 | 250,000 | 2,900 | 1.02 | 0.76 |
| | 4 | 240,000 | 3,000 | 0.99 | 0.75 |
| | 5 | 240,000 | 3,000 | 0.99 | 0.76 |
| | 6 | 64,000 | 12,000 | 1.02 | — |

In Table 2-2, "–" in the column "ΔH(H)/ΔH(T)" of Comparative Example 6 means that the ΔH(H) could not measured.

TABLE 2-3

| | | Average circularity of Toner | Volume average particle diameter of Toner Dv (μm) | Amount of crystalline structure C/(A + C) | Resistivity (Ω · cm) | Transferability | Heat-resistant storage stability | Low-Temperature Fixing Property (° C.) |
|---|---|---|---|---|---|---|---|---|
| Example | 1 | 0.97 | 6.2 | 0.30 | 11.2 | A | B | 105 |
| | 2 | 0.97 | 6.5 | 0.23 | 10.6 | C | B | 105 |
| | 3 | 0.98 | 6.3 | 0.36 | 11.1 | A | C | 100 |
| | 4 | 0.98 | 6.1 | 0.31 | 10.9 | A | C | 115 |
| | 5 | 0.98 | 6.2 | 0.22 | 10.8 | B | B | 110 |
| | 6 | 0.98 | 6.2 | 0.25 | 10.6 | C | B | 110 |
| | 7 | 0.97 | 6.2 | 0.33 | 11.2 | A | B | 105 |
| | 8 | 0.97 | 6.0 | 0.15 | 10.5 | B | B | 115 |
| | 9 | 0.97 | 6.2 | 0.21 | 10.9 | B | B | 115 |
| | 10 | 0.97 | 5.9 | 0.29 | 10.6 | B | B | 110 |
| | 11 | 0.97 | 5.8 | 0.30 | 10.9 | B | B | 110 |
| | 12 | 0.98 | 6.3 | 0.29 | 10.8 | B | B | 110 |
| | 13 | 0.97 | 6.2 | 0.33 | 112 | A | B | 120 |
| | 14 | 0.97 | 6.2 | 0.30 | 11.2 | A | C | 100 |
| | 15 | 0.98 | 6.2 | 0.28 | 11.0 | A | C | 105 |
| Comparative Example | 1 | 0.98 | 6.1 | 0.28 | 10.8 | B | D | 100 |
| | 2 | 0.98 | 6.1 | 0.21 | 10.1 | D | A | 105 |
| | 3 | 0.98 | 6.3 | 0.30 | 10.5 | C | D | 105 |
| | 4 | 0.97 | 6.0 | 0.25 | 10.0 | D | A | 115 |
| | 5 | 0.97 | 6.0 | 0.23 | 10.3 | D | A | 105 |
| | 6 | 0.98 | 5.8 | 0 | 11.1 | A | B | 140 |

In Table 2-1, the contained amounts of the added compounds mean the amounts of the added compounds contained in the toner (% by mass).

Embodiments of the present invention are as follows:

<1> A toner, including:

a crystalline resin containing a urethane bond, a urea bond, or both thereof; and a compound represented by the following General Formula (1), wherein an amount of the compound represented by the following General Formula (1) is 0.01% by mass to 0.25% by mass:

$$C_nH_{2n+1}R \qquad \text{General Formula (1)}$$

where n is 8 to 22 and R is COOH, $NH_2$ or OH.

<2> The toner according to <1>, wherein a ratio [C/(A+C)] of (C) integrated intensity of a spectrum derived from a crystalline structure to a sum of the (C) and (A) integrated intensity of a spectrum derived from a non-crystalline structure in a diffraction spectrum of the toner obtained by X-ray diffraction measurement is 0.15 or more.

<3> The toner according to <1> or <2>, wherein a ratio (Tsh 2nd/Tsh 1st) of a shoulder temperature of a peak of heat of fusion in a first heating (Tsh 1st) and a shoulder temperature of a peak of heat of fusion in a second heating (Tsh 2nd) in a measurement of the toner by a differential scanning calorimetry (DSC) is 0.90 to 1.10.

<4> The toner according to any one of <1> to <3>, wherein the toner has a volume resistivity (logR) of 10.5 to 12.0.

<5> The toner according to any one of <1> to <4>, wherein the n in the General Formula (1) is 9 to 20.

<6> The toner according to any one of <1> to <5>, wherein the compound represented by the General Formula (1) is contained in an amount of 0.050% by mass to 0.100% by mass.

<7> The toner according to any one of <1> to <6>, wherein a storage elastic modulus at 70° C., G' (70), is $5.0\times10^4$ Pa≤G' (70)≤$5.0\times10^5$ Pa.

<8> The toner according to any one of <1> to <7>, wherein a tetrahydrofuran soluble content of the toner includes, on a peak area basis, 7.0% or more of a component having a molecular weight of 100,000 or greater in a molecular weight distribution measured by gel permeation chromatography; and wherein a weight average molecular weight of the tetrahydrofuran soluble content of the toner is 20,000 to 70,000.

<9> The toner according to any one of <1> to <8>, wherein a ratio [ΔH(H)/ΔH(T)] of an endothermic amount [ΔH(H), (J/g)] of an insoluble content of the toner to a mixed solution of tetrahydrofuran and ethyl acetate [tetrahydrofuran/ethyl acetate=50/50 (mass ratio)] in differential scanning calorimetry to an endothermic amount [ΔH(T), (J/g)] of the toner in the differential scanning calorimetry is 0.20 to 1.25.

<10> A developer, including:

the toner according to any one of <1> to <9>; and a carrier.

<11> An image forming apparatus, including:

an electrostatic latent image bearing member;

an electrostatic latent image forming unit configured to form an electrostatic latent image on the electrostatic latent image bearing member; and a developing unit containing a toner and configured to develop the electrostatic latent image which has been formed on the electrostatic latent image bearing member to thereby form a visible image, wherein the toner is the toner according to any one of <1> to <9>.

This application claims priority to Japanese application No. 2012-192118, filed on Aug. 31, 2012, and Japanese application No. 2013-004595, filed on Jan. 15, 2013, and incorporated herein by reference.

What is claimed is:

1. A toner, comprising:

a crystalline resin containing a urethane bond, a urea bond, or both thereof; and a compound represented by the following General Formula (1), wherein an amount of the compound represented by the following General Formula (1) is 0.01% by mass to 0.25% by mass:

$C_nH_{2n+1}R$ General Formula (1)

where n is 8 to 22 and R is COOH, $NH_2$ or OH.

2. The toner according to claim 1, wherein a ratio [C/(A+C)] of (C) integrated intensity of a spectrum derived from a crystalline structure to a sum of the (C) and (A) integrated intensity of a spectrum derived from a non-crystalline structure in a diffraction spectrum of the toner obtained by X-ray diffraction measurement is 0.15 or more.

3. The toner according to claim 1, wherein a ratio (Tsh 2nd/Tsh 1st) of a shoulder temperature of a peak of heat of fusion in a first heating (Tsh 1st) and a shoulder temperature of a peak of heat of fusion in a second heating (Tsh 2nd) in a measurement of the toner by a differential scanning calorimetry (DSC) is 0.90 to 1.10.

4. The toner according to claim 1, wherein the toner has a volume resistivity (logR) of 10.5 to 12.0.

5. The toner according to claim 1, wherein the n in the General Formula (1) is 9 to 20.

6. The toner according to claim 1, wherein the compound represented by the General Formula (1) is contained in an amount of 0.050% by mass to 0.100% by mass.

7. The toner according to claim 1, wherein a storage elastic modulus at 70° C., G' (70), is $5.0\times10^4$ Pa≤G' (70)≤$5.0\times10^5$ Pa.

8. The toner according to claim 1, wherein a tetrahydrofuran soluble content of the toner includes, on a peak area basis, 7.0% or more of a component having a molecular weight of 100,000 or greater in a molecular weight distribution measured by gel permeation chromatography; and wherein a weight average molecular weight of the tetrahydrofuran soluble content of the toner is 20,000 to 70,000.

9. The toner according to claim 1, wherein a ratio [ΔH(H)/ΔH(T)] of an endothermic amount [ΔH(H), (J/g)] of an insoluble content of the toner to a mixed solution of tetrahydrofuran and ethyl acetate [tetrahydrofuran/ethyl acetate=50/50 (mass ratio)] in differential scanning calorimetry to an endothermic amount [ΔH(T), (J/g)] of the toner in the differential scanning calorimetry is 0.20 to 1.25.

10. A developer comprising:

a toner; and a carrier, wherein the toner contains a crystalline resin containing a urethane bond, a urea bond, or both thereof, and a compound represented by the following General Formula (1), wherein an amount of the compound represented by the following General Formula (1) is 0.01% by mass to 0.25% by mass:

$C_nH_{2n+1}R$ General Formula (1)

where n is 8 to 22 and R is COOH, $NH_2$ or OH.

11. The developer according to claim 10, wherein a ratio [C/(A+C)] of (C) integrated intensity of a spectrum derived from a crystalline structure to a sum of the (C) and (A) integrated intensity of a spectrum derived from a non-crystalline structure in a diffraction spectrum of the toner obtained by X-ray diffraction measurement is 0.15 or more.

12. The developer according to claim 10, wherein a ratio (Tsh 2nd/Tsh 1st) of a shoulder temperature of a peak of heat of fusion in a first heating (Tsh 1st) and a shoulder temperature of a peak of heat of fusion in a second heating (Tsh 2nd) in a measurement of the toner by a differential scanning calorimetry (DSC) is 0.90 to 1.10.

13. The developer according to claim 10, wherein the toner has a volume resistivity (logR) of 10.5 to 12.0.

14. The developer according to claim 10, wherein the n in the General Formula (1) is 9 to 20.

15. The developer according to claim 10, wherein the compound represented by the General Formula (1) is contained in an amount of 0.050% by mass to 0.100% by mass.

16. An image forming apparatus, comprising:

an electrostatic latent image bearing member;

an electrostatic latent image forming unit configured to form an electrostatic latent image on the electrostatic latent image bearing member; and a developing unit containing a toner and configured to develop the electrostatic latent image which has been formed on the electrostatic latent image bearing member to thereby form a visible image, wherein the toner contains a crystalline resin containing a urethane bond, a urea bond, or both thereof and a compound represented by the following General Formula (1), wherein an amount of the compound represented by the following General Formula (1) is 0.01% by mass to 0.25% by mass:

$C_nH_{2n+1}R$ General Formula (1)

where n is 8 to 22 and R is COOH, $NH_2$ or OH.

17. The image forming apparatus according to claim 16, wherein a ratio [C/(A+C)] of (C) integrated intensity of a spectrum derived from a crystalline structure to a sum of the (C) and (A) integrated intensity of a spectrum derived from a non-crystalline structure in a diffraction spectrum of the toner obtained by X-ray diffraction measurement is 0.15 or more.

18. The image forming apparatus according to claim 16, wherein a ratio (Tsh 2nd/Tsh 1st) of a shoulder temperature of a peak of heat of fusion in a first heating (Tsh 1st) and a shoulder temperature of a peak of heat of fusion in a second heating (Tsh 2nd) in a measurement of the toner by a differential scanning calorimetry (DSC) is 0.90 to 1.10.

19. The image forming apparatus according to claim 16, wherein the toner has a volume resistivity (logR) of 10.5 to 12.0.

20. The image forming apparatus according to claim 16, wherein the n in the General Formula (1) is 9 to 20.

* * * * *